US011473352B2

(12) United States Patent
Guillemette

(10) Patent No.: US 11,473,352 B2
(45) Date of Patent: Oct. 18, 2022

(54) MULTIPOINT DOOR LOCK SYSTEM

(71) Applicant: Christian Guillemette, Beauport (CA)

(72) Inventor: Christian Guillemette, Beauport (CA)

( * ) Notice: Subject to any disclaimer, the term of this patent is extended or adjusted under 35 U.S.C. 154(b) by 0 days.

(21) Appl. No.: 17/424,237

(22) PCT Filed: Jan. 16, 2020

(86) PCT No.: PCT/CA2020/050041

§ 371 (c)(1),
(2) Date: Jul. 20, 2021

(87) PCT Pub. No.: WO2020/154795

PCT Pub. Date: Aug. 6, 2020

(65) Prior Publication Data

US 2022/0112748 A1 Apr. 14, 2022

Related U.S. Application Data

(60) Provisional application No. 62/800,077, filed on Feb. 1, 2019.

(51) Int. Cl.
*E05C 9/04* (2006.01)
*E05B 63/00* (2006.01)
(Continued)

(52) U.S. Cl.
CPC ..... *E05C 9/043* (2013.01); *E05B 63/0004* (2013.01); *E05B 63/242* (2013.01);
(Continued)

(58) Field of Classification Search
CPC ..... Y10T 292/0839; Y10T 292/1071; Y10T 292/1072; Y10T 292/1016;
(Continued)

(56) References Cited

U.S. PATENT DOCUMENTS 922,675 A * 5/1909 Day ..... E05B 63/242 70/99
1,145,185 A * 7/1915 Coleman ..... E05C 19/02 292/207
(Continued)

FOREIGN PATENT DOCUMENTS

CN 102182364 A 9/2011
DE 329698 C * 11/1920 ..... E05B 63/02
(Continued)

OTHER PUBLICATIONS

International Search Report of PCT/IB2016/056296; Pengfei Zhang; dated Jan. 25, 2017.
(Continued)

*Primary Examiner* — Kristina R Fulton
*Assistant Examiner* — Steven A Tullia
(74) *Attorney, Agent, or Firm* — BCF LLP

(57) ABSTRACT

A multipoint door lock system comprises a door frame having a bolt opening and a secondary opening. A latch takes an activable position when the door is opened and a pre-armed position when the door is closed. A door-locking tip of the latch protrudes from the secondary opening of the door frame and into a secondary bore of the door when the door is closed. A transfer block moves from an inactive position to an active position upon insertion the deadbolt in the bolt opening. A biasing element causes a displacement of a translating member when the transfer block moves to the active position in the absence of a force sufficient to cause a compression of the biasing element. This action of the translating member locks the latch in its pre-armed position within the secondary bore.

15 Claims, 20 Drawing Sheets

(51) Int. Cl.
*E05B 63/24* (2006.01)
*E05C 9/18* (2006.01)
*E05B 17/20* (2006.01)

(52) U.S. Cl.
CPC ..... *E05C 9/185* (2013.01); *E05C 9/1891* (2013.01); *E05B 17/2038* (2013.01)

(58) Field of Classification Search
CPC ..... Y10T 292/1089; Y10T 292/54; Y10T 292/546; E05C 9/043; E05C 9/185; E05C 9/1891; E05C 7/06; E05C 7/045; E05B 63/0004; E05B 63/242; E05B 17/2038; E05B 63/205; E05B 63/0052; Y10S 292/12; Y10S 292/21; Y10S 292/44
See application file for complete search history.

(56) References Cited

U.S. PATENT DOCUMENTS 1,216,765 A * 2/1917 Anderson ..... E05B 85/24 292/26
2,381,633 A * 8/1945 Young ..... E05C 3/24 292/341.17
2,446,735 A * 8/1948 Banliam ..... E05B 63/242 292/34
3,758,142 A 9/1973 Gartner
3,788,679 A * 1/1974 Banham ..... E05B 63/242 292/341.17
4,529,234 A 7/1985 Senften
4,539,828 A * 9/1985 Teleky ..... E05G 1/026 70/369
4,679,834 A 7/1987 Gotanda
4,840,050 A 6/1989 Gotanda
5,498,038 A 3/1996 Simon et al.
6,733,051 B1 * 5/2004 Cowper ..... E05B 63/242 292/192
9,765,550 B2 * 9/2017 Hemmingsen ..... E05B 65/00
10,557,294 B2 2/2020 Guillemette
2008/0078216 A1 4/2008 Fleming
2008/0156048 A1 * 7/2008 Topfer ..... E05B 65/1086 70/77
2015/0252595 A1 * 9/2015 Hagemeyer ..... E05C 9/1875 292/138
2018/0202194 A1 * 7/2018 Jaskiewicz ..... E05B 63/14

FOREIGN PATENT DOCUMENTS

DE 102016012604 A1 * 4/2018 ..... E05B 47/0012
EP 1516984 A2 * 3/2005 ..... B61D 19/008
EP 3680427 A1 * 7/2020 ..... E05B 47/026
EP 3822437 A1 * 5/2021 ..... E05B 53/003
FR 332254 A * 5/1903 ..... E05B 17/2007
FR 363424 A * 1/1906 ..... E05B 63/242
FR 370890 A * 10/1906 ..... E05B 63/242
FR 967294 A * 5/1948 ..... E05B 63/242
FR 2616837 A1 * 6/1987 ..... E05B 63/242
FR 2884847 A1 * 10/2006 ..... E05B 63/02
GB 173299 A * 9/1920 ..... E05B 63/242
GB 395910 A * 10/1932 ..... E05B 63/242
GB 2299612 A * 10/1996 ..... E05B 63/242
WO WO-0142600 A1 * 6/2001 ..... E05B 63/242
WO 2010107468 A1 9/2010
WO 2017068518 A1 4/2017
WO WO-2017068518 A1 * 4/2017 ..... E05B 17/2007

OTHER PUBLICATIONS

English Translation of CN102182364A received from the ISA/CA; retrieved on Jan. 25, 2017.
International Search Report of PCT/CA2020/050041; Kristian MacKenzie; dated May 1, 2020.

* cited by examiner

MULTIPOINT DOOR LOCK SYSTEM

CROSS-REFERENCE

The present application claims priority to U.S. Provisional Application Ser. No. 62/800,077, filed on Feb. 1, 2019, the disclosure of which is incorporated by reference herein.

TECHNICAL FIELD

The present disclosure relates to the field of door locks. More specifically, the present disclosure relates to a multipoint door lock system.

BACKGROUND

One of the most commonly used types of locks securing doors in residential and commercial applications is the deadbolt. As is well-known, a deadbolt can only be moved between its retracted (unlocked) and extended (locked) positions by rotating a lock cylinder with a key. The deadbolt, when in its extended position, penetrates into a bolt opening of a door frame. It is difficult to defeat a deadbolt by so-called "jimmying" action. Regardless, most doors locked with deadbolts can be opened by exerting on such door a brute force sufficient to break the frame in the bolt opening area.

Conventional multipoint door locks alleviate this problem by providing additional elements that extend from the door into the door frame when locked. The amount of force required to overcome multipoint door locks is multiplied in view of the number of additional elements.

However, conventional multipoint door locks are expensive in part because they require important modifications to the doors on which they are installed. In fact, many doors cannot be modified to accommodate the installation of conventional multipoint door locks. When it is possible to install a conventional multipoint door lock on an existing door, this can only be achieved through a labor-intensive process. Some doors are provided with factory-installed multipoint door locks; however the cost of these doors is usually prohibitive.

A multipoint door lock system is described in Canadian Patent No. 2,969,183 C issued on Jan. 2, 2018 to Christian Guillemette, the disclosure of which is incorporated by reference herein. A pivotable latch mounted in the door frame has a door-locking tip that enters the secondary bore of the door when the door is closed. Insertion of the deadbolt in a bolt opening of the door frame causes a lever to move from a resting position, displacing a translating member mounted in the door frame to an extended position. A distal end of the translating member enters a recess of the pivotable latch, locking the pivotable latch. This multipoint door lock system is effective and economical. However, components of the multipoint door lock system may remain stuck in an undesired position within the door frame, this situation resulting for instance from an incorrect installation of the multipoint door lock system or from an accumulation of foreign matters within the door frame. In one case, the door may remain locked when the deadbolt is removed from the bolt opening. In another case, the deadbolt may be prevented from entering the bolt opening, leading to failed attempts to lock the door.

Therefore, there is a need for techniques that compensate for above described limitations of currently available multipoint door locks.

SUMMARY

According to the present disclosure, there is provided a multipoint door lock system for a door having on its edge a deadbolt and a secondary bore separated from the deadbolt. The system comprises a door frame, a latch, a transfer block, first and second biasing elements, and a translating member. The door frame has a bolt opening adapted for insertion of the deadbolt and a secondary opening. The latch is mounted in the door frame. The latch takes an activable position when the door is opened and a pre-armed position when the door is closed. A door-locking tip of the latch protrudes from the secondary opening of the door frame and into the secondary bore when the door is closed. The transfer block is supported by the door frame and moves from an inactive position to an active position upon insertion the deadbolt in the bolt opening. The first biasing element is mounted to the door frame and is adapted to cause the transfer block to return to the inactive position when the deadbolt is removed from the bolt opening. The translating member is mounted in the door frame. The second biasing element connects the translating member to the transfer block. Moving the transfer block to the active position in the absence of a force sufficient to cause a compression of the second biasing element causes a displacement of the translating member to lock the latch in its pre-armed position within the secondary bore.

According to the present disclosure, there is also provided a multipoint door lock system. The system comprises a door, a door frame, a latch, a transfer block, first and second biasing elements, and a translating member. The door has on its edge a deadbolt and a secondary bore separated from the deadbolt. The door frame has a bolt opening adapted for insertion of the deadbolt and a secondary opening. The latch is mounted in the door frame. The latch takes an activable position when the door is opened and a pre-armed position when the door is closed. A door-locking tip of the latch protrudes from the secondary opening of the door frame and into the secondary bore when the door is closed. The transfer block is supported by the door frame and moves from an inactive position to an active position upon insertion the deadbolt in the bolt opening. The first biasing element is mounted to the door frame and is adapted to cause the transfer block to return to the inactive position when the deadbolt is removed from the bolt opening. The translating member is mounted in the door frame. The second biasing element connects the translating member to the transfer block. Moving the transfer block to the active position in the absence of a force sufficient to cause a compression of the second biasing element causes a displacement of the translating member to lock the latch in its pre-armed position within the secondary bore.

The present disclosure further provides a multipoint door lock system. The system comprises a door, a door frame, a latch, a transfer block, first and second biasing elements, a translating member, a lever and a compressible interface. The door has on its edge a deadbolt and a secondary bore separated from the deadbolt. The door frame has a bolt opening adapted for insertion of the deadbolt and a secondary opening. The latch is mounted in the door frame. The latch takes an activable position when the door is opened and a pre-armed position when the door is closed. A door-locking tip of the latch protrudes from the secondary opening of the door frame and into the secondary bore when the door is closed. The translating member is mounted in the door frame. The lever is pivotably supported by the door frame and is adapted to pivot upon insertion of the deadbolt in the bolt opening. The compressible interface assembly is operatively connecting the lever to the translating member. The compressible interface assembly is adapted to cause a displacement of the translating member to lock the latch in the pre-armed position within the secondary opening when the lever pivots upon insertion of the deadbolt in the bolt opening in the absence of a force sufficient to compress the compressible interface assembly.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Figure 2:
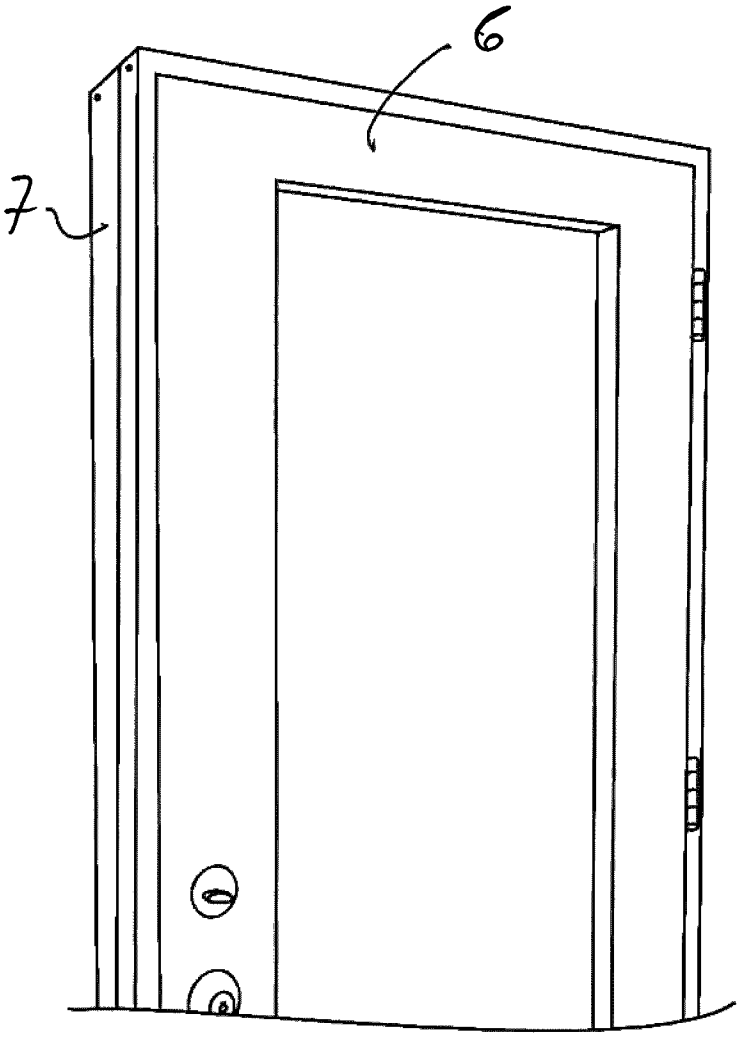
FIG. 2 is a perspective, partial view of a door mounted in a conventional door frame.

Various aspects of the present disclosure generally address one or more of the deficiencies of conventional multipoint door locks.

Generally speaking, elements of the present multipoint door lock are integrated in a door frame, more specifically in a subframe that can be mounted on a conventional door frame. An ordinary door provided with a deadbolt is mounted in the subframe. The ordinary door is modified with the simple cutting of one or more additional bores, or secondary bores, on its edge, separated from the deadbolt. One or more pivotable latches are provided in the subframe, each pivotable latch corresponding to one secondary bore. The pivotable latches protrude through the subframe in secondary openings that will face the secondary bores of the door when the door is closed in its door frame. When the door is open, door-actuated tips of the pivotable latches protrude from the door frame; in some embodiments, the pivotable latches may pivot freely in the subframe. Upon closing the door, the edge of the door activates the pivotable latches by pushing on the door-actuated tips, causing a rotation of the pivotable latches. The door-actuated tips penetrate into the door frame, causing door-locking tips of the pivotable latches to protrude from the door frame and enter in the secondary bores of the door. Though the door-locking tips are now positioned in the secondary bores, the door remains unlocked because the pivotable latches will easily rotate, causing the door-locking tips to re-enter the door frame and the door-actuated tips to protrude again from the door frame if the door is opened. When the door is closed, the position of the door-locking tips of the latches within the secondary bores of the door effectively pre-arms the multipoint door lock without however preventing normal, keyless opening of the door because the door is yet locked when the multipoint door lock is in this pre-armed condition. Upon locking of the door, the deadbolt pushes on a lever provided in a bolt opening of the subframe. This lever displaces one or more translating members that lead toward the pivotable latches. In more details, the action of the lever may be transmitted to the translating members via an interface block that is displaced in one direction when the deadbolt enters the bolt opening and pushes on the lever, the interface block being displaced in an opposite direction when the deadbolt is removed from the bolt opening. A tip of each translating member penetrates in a recess of the pivotable latches, preventing their rotation. At that time, the deadbolt and the pivotable latches each form a locking point for the door. The pivotable latches now effectively lock the door without moving from their pre-armed positions. Unlocking the door causes the deadbolt to exit from the bolt opening of the subframe. The translating members are pulled back, their tip no longer locking the pivotable latches that however maintain their pre-armed positions until the door is opened again.

In an embodiment, the above-described interface block is replaced with a compressible interface assembly that includes a guiding block, a transfer block, and a biasing member that provides a connection between the transfer block and the translating member. Upon locking of the door, the deadbolt pushes on a lever provided in the bolt opening of the subframe. The lever pushes on the transfer block that slides in the guiding block, moving from an inactive position to an active position. In turn, the transfer block pushes on the translating members. In normal operation, the translating members follow the movement of the transfer block and are displaced to lock the pivotable latches. If, for example due to an improper installation of the multipoint door lock system or due to any other reason, the tips of the translating members fail to penetrate in the recesses of the pivotable latches, biasing elements disposed between the transfer block and the translating members, for example springs mounted on the translating members, become compressed and ends of the translating members slide in apertures of the transfer block. The translating members as a whole are not displaced in this situation. Although the secondary latches may not lock the door in this particular situation, the door can still be safely locked by the ordinary deadbolt.

A pusher may be provided to allow emergency unlocking of the multipoint door lock system. The transfer block might become stuck in the active position, for example due to an improper installation of the multipoint door lock system. As expressed hereinabove, the transfer block is displaced when the deadbolt enters the bolt opening, causing the tips of the translating members to penetrate into the recess of the pivotable latches, preventing their rotation. If, for any reason, the transfer block fails to return to the inactive position when the deadbolt is removed from the bolt opening, the tip of the translating members might fail to release the pivotable latches. In this situation, a user may unlock the multipoint door lock system by entering the tip of a thin object, for example a nail, into an emergency unlocking aperture provided in the subframe immediately above a level of the transfer block. The tip of the thin object applies pressure on a pusher that pivots and transmits the pressure on the transfer block that returns to the inactive position. This motion of the transfer block assembly causes the translating members to return to their unlocked position, freeing the pivotable latches.

Figure 1:
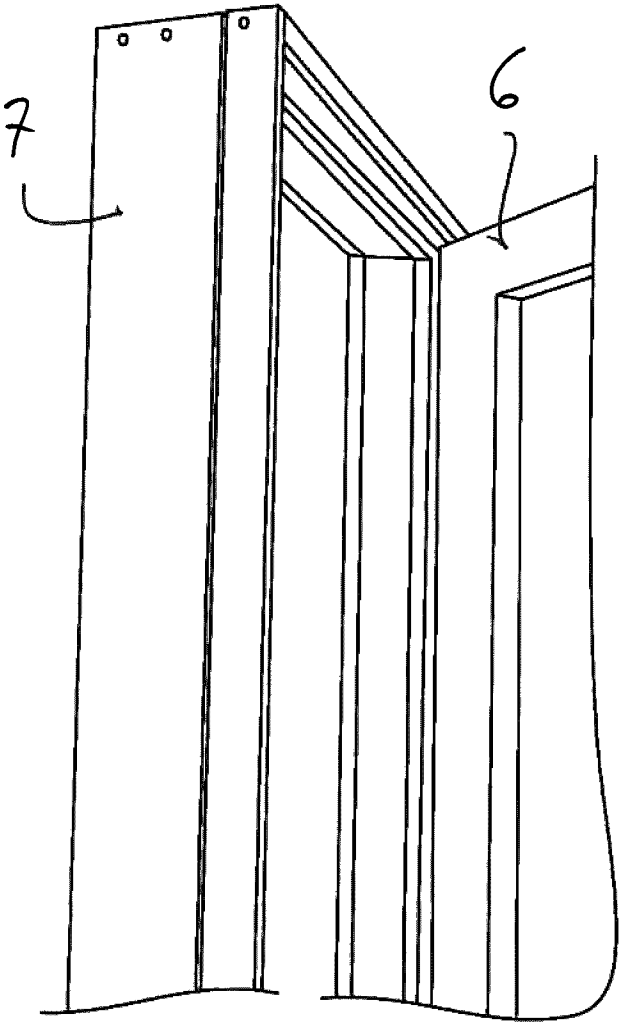
FIG. 1 is a perspective, partial view of a conventional door frame.

Referring now to the drawings, FIG. 1 is a perspective, partial view of a conventional door frame. FIG. 2 is a perspective, partial view of a door mounted in a conventional door frame. A door 6 is mounted in a door frame 7, for example but not exclusively a wooden frame, having a width corresponding to a depth of a wall in which the door 6 and the door frame 7 will be mounted. When closed, the door 6 is generally flush with an internal face of the door frame 7.

Figure 4:
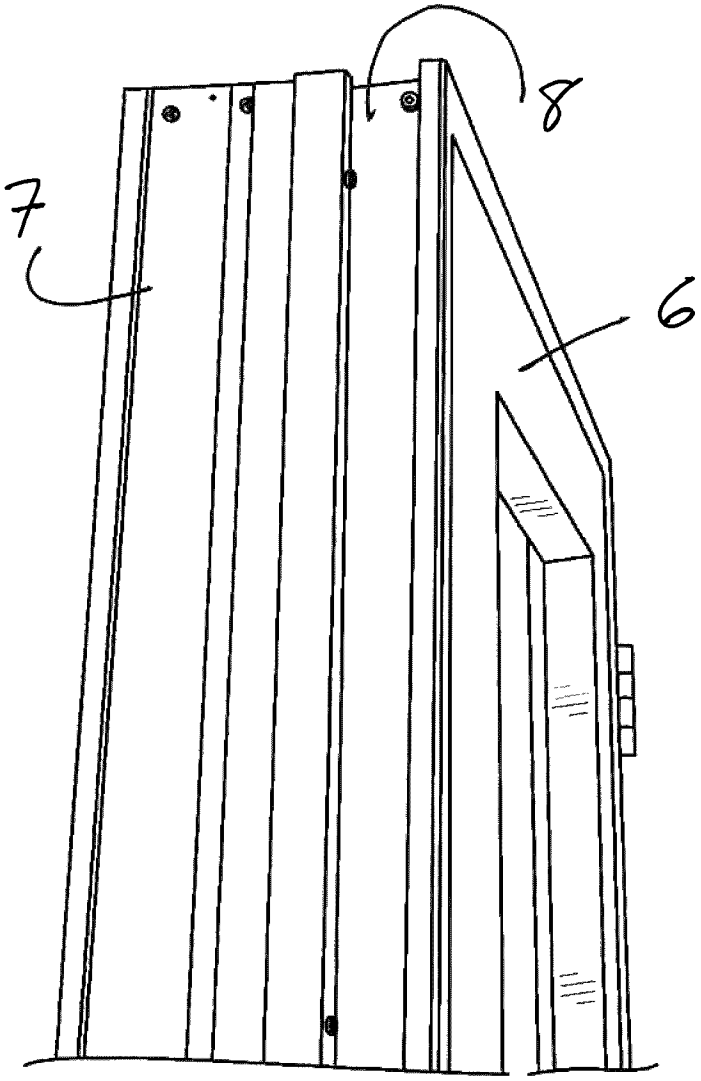
FIG. 4 is a perspective view of a subframe according to an embodiment, mounted on the door frame of FIG. 1 after the conventional door frame has been cut.
Figure 3:
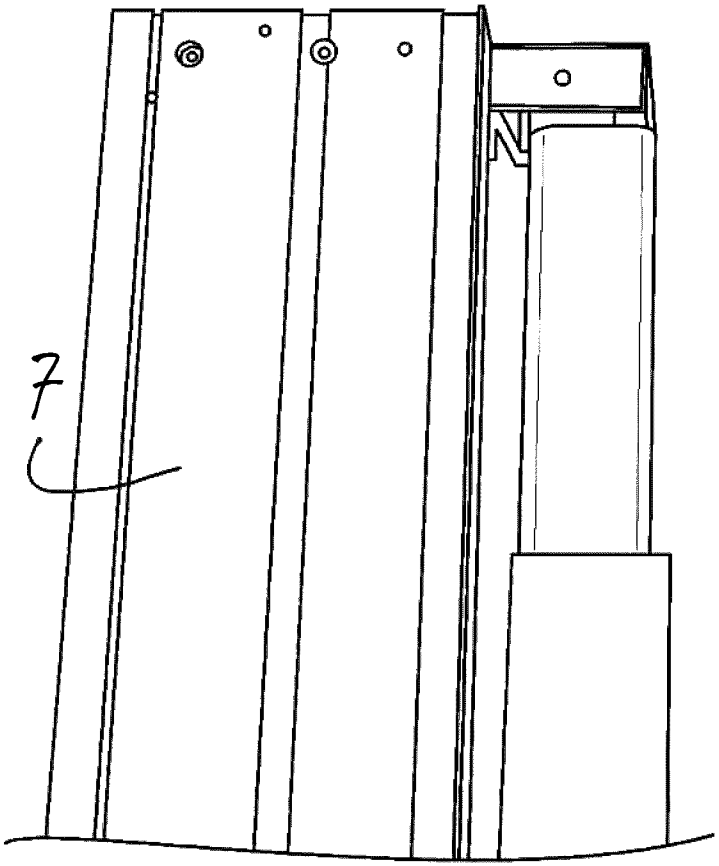
FIG. 3 is a top view of the door frame of FIG. 1 illustrating a method of cutting into the conventional door frame of FIG. 1.
Figure 6:
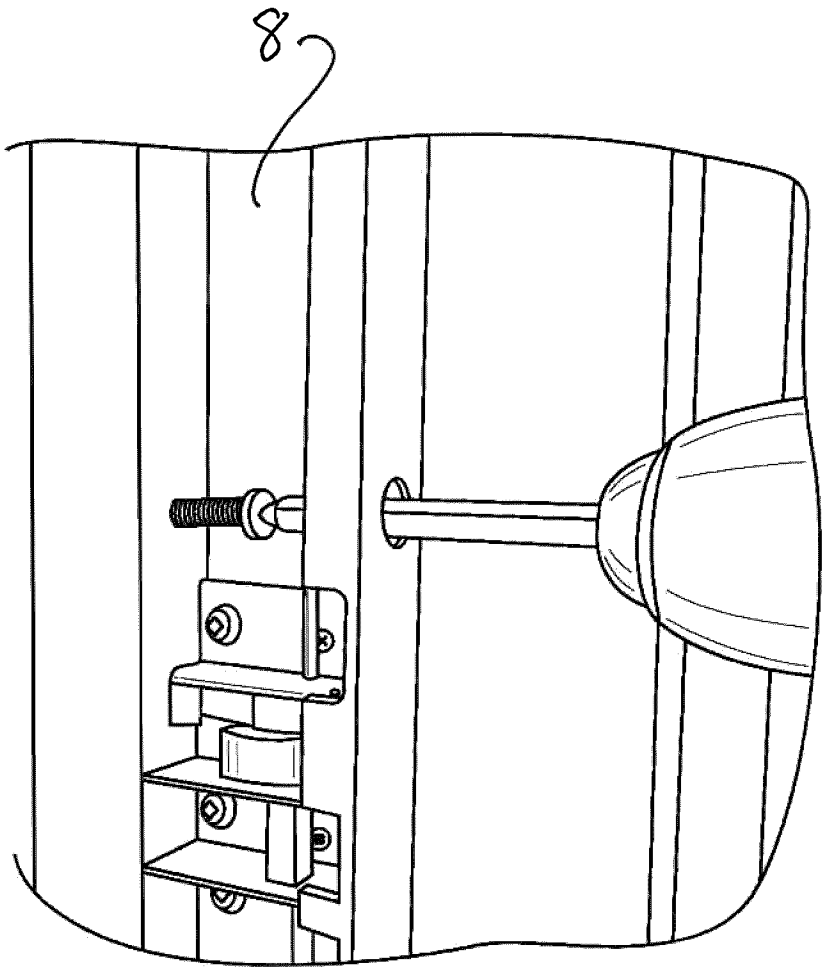
FIG. 6 is a detailed view showing a manner of installing the subframe on the conventional door frame after it has been cut.
Figure 5:
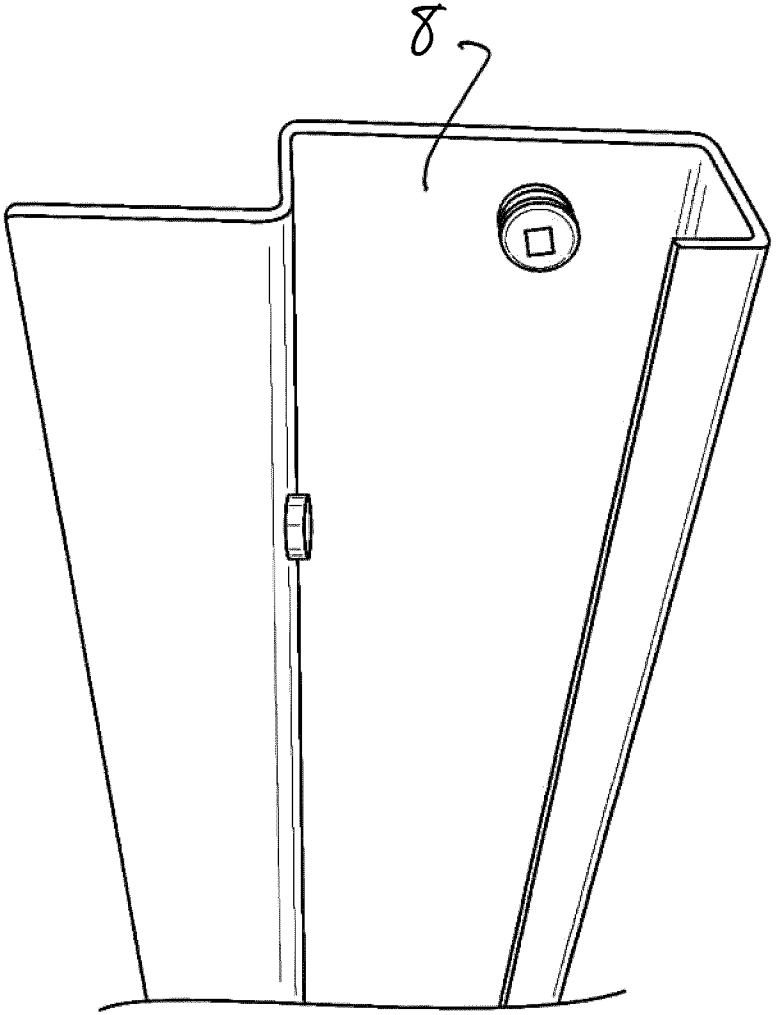
FIG. 5 is a detailed view of the subframe of FIG. 4.

FIG. 3 is a top view of the door frame of FIG. 1 illustrating a method of cutting into the conventional door frame of FIG. 1. FIG. 4 is a perspective view of a subframe according to an embodiment, mounted on the door frame of FIG. 1 after the conventional door frame has been cut. FIG. 5 is a detailed view of the subframe of FIG. 4. The profile of a subframe 8 is for illustration purposes and does not limit the present disclosure. FIG. 6 is a detailed view showing a manner of installing the subframe 8 on the conventional door frame 7 after it has been cut. With the door 6 dismounted from the door frame 7, a cutaway section of the door frame 7 is removed and replaced with the subframe 8 that will receive the present multipoint door lock system. In most cases, the original door frame 7 can be cut and the subframe 8 can be installed on the remaining parts of the door frame 7 using ordinary tools. Alternatively, the complete door frame 7 of FIGS. 1 and 2 could be replaced with a complete new door frame 7 including the elements of the subframe 8. The cutaway section of the door frame 7 in the particular example shown on FIG. 3 extends to the top and bottom of this door frame 7. Likewise, the subframe 8 of FIG. 4 extends to the top and bottom of the door frame 7. In a variant, the cutaway section of the door frame 7 and the subframe 8 may extend along less than a full height of the door frame 7 so it becomes easier to cut the top and/or the bottom of the door frame 7 when it is desired to mount the door frame 7 and the door 6 in an opening that may be somewhat smaller than a typical door opening height. In an alternate embodiment, the door frame 7 may be replaced by another door frame that includes all components of the subframe 8. Regardless, when the cutaway section is removed from the door frame 7 and replaced by the subframe 8, the subframe 8 becomes may be considered as an integral part of the door frame 7.

Figure 7:
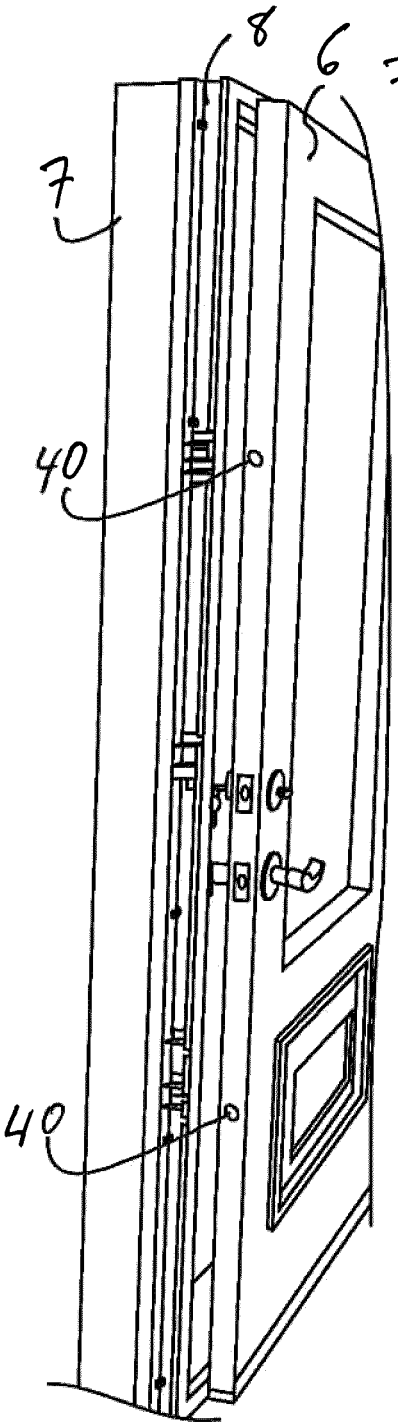
FIG. 7 is a perspective view of a multipoint door lock system according to an embodiment.
Figure 8:
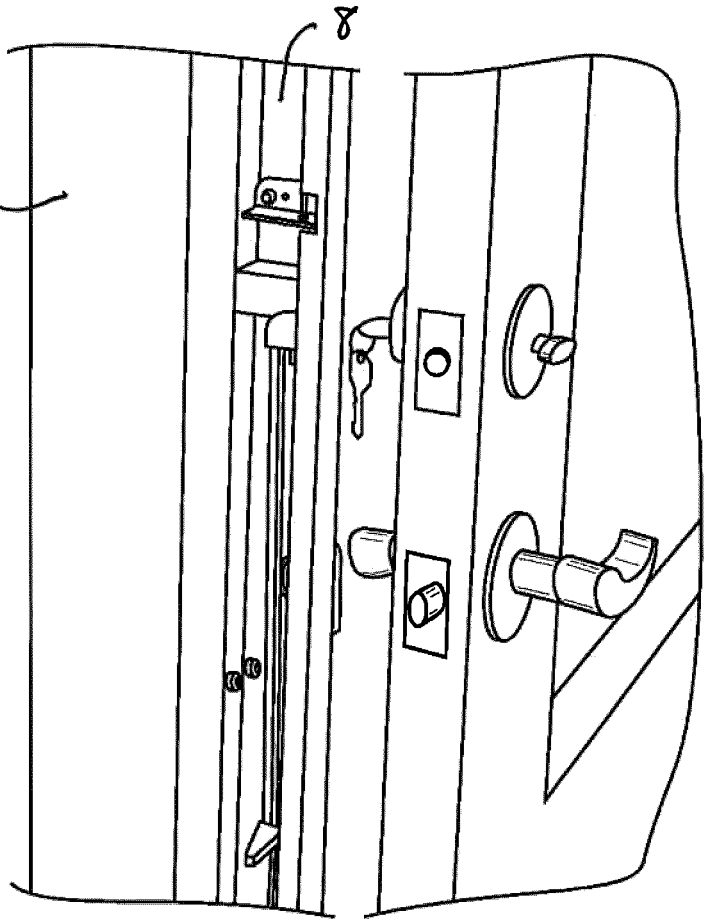
FIG. 8 is a detailed view of the multipoint door lock system of FIG. 7.
Figure 9:
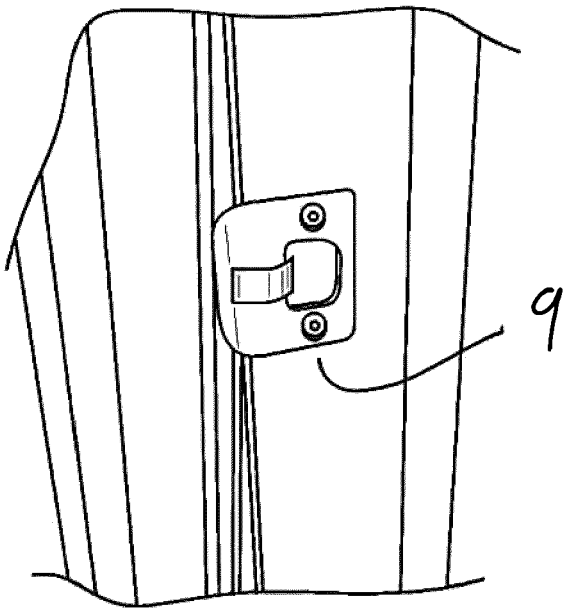
FIG. 9 is a detailed view of a striking plate mounted on a strike jamb of the door locking system of FIG. 7.

FIG. 7 is a perspective view of a multipoint door lock system according to an embodiment. FIG. 8 is a detailed view of the multipoint door lock system of FIG. 7. FIG. 9 is a detailed view of a doorknob latch mounted on a strike jamb of the door locking system of FIG. 7. A strike plate (not shown) may also be mounted on a strike jamb 9. As illustrated, the subframe 8 of the door frame 7 comprises a profile made of metal such as steel or aluminum. Provided that an internal face of the subframe 8 is painted or covered with a plastic finish (not shown), the door and door frame assembly will not be visually different from an ordinary door and door frame assembly once installed. FIG. 7 illustrates an embodiment in which a deadbolt is complemented with two (2) additional latches. Variants in which one, two, or more pivotable latches are implemented in the multipoint door lock system are also contemplated.

Figure 10:
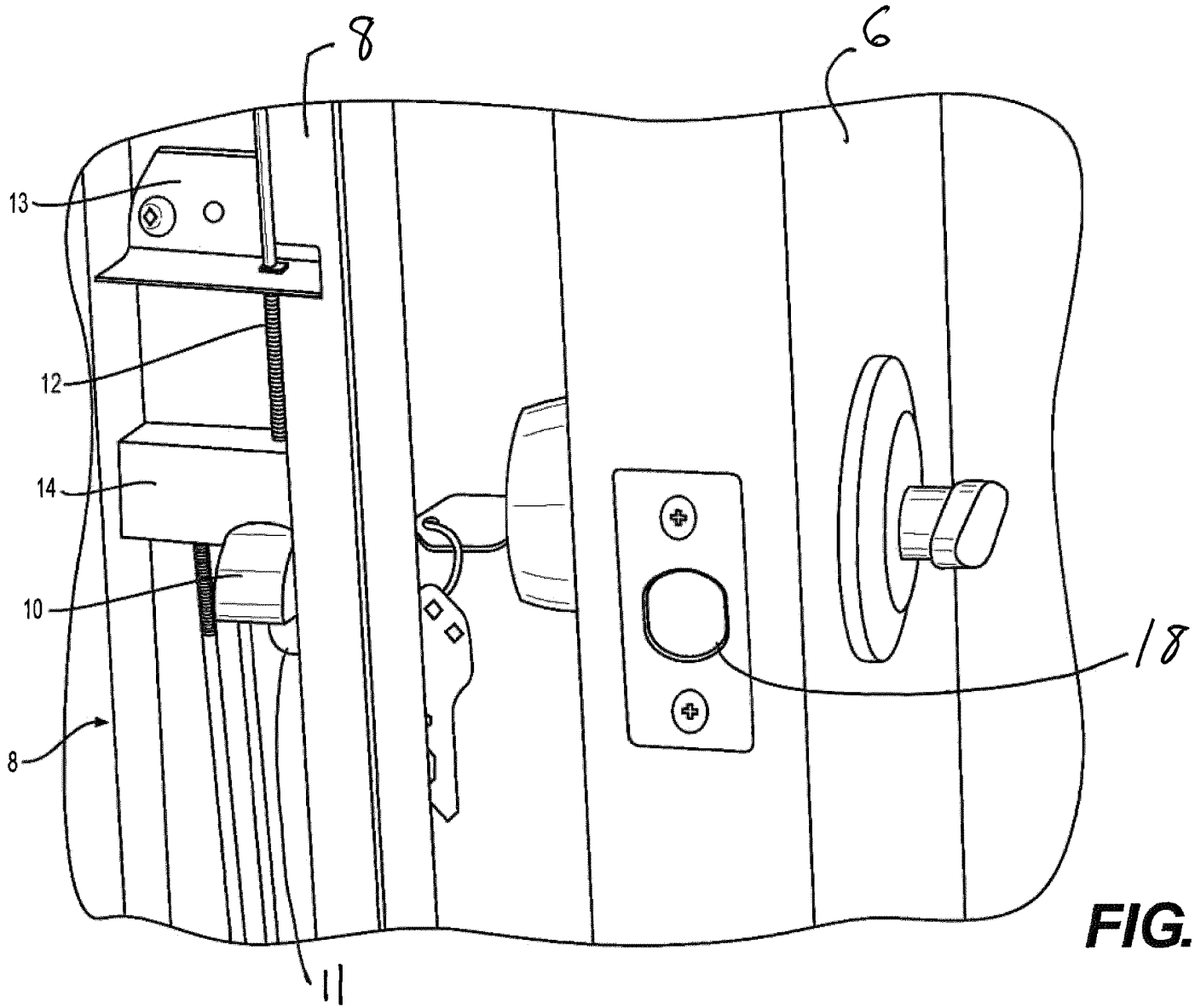
FIG. 10 is a detailed view of the multipoint door lock system of FIG. 7, showing a lever mounted in the subframe and in a resting position, with an open door.
Figure 11:
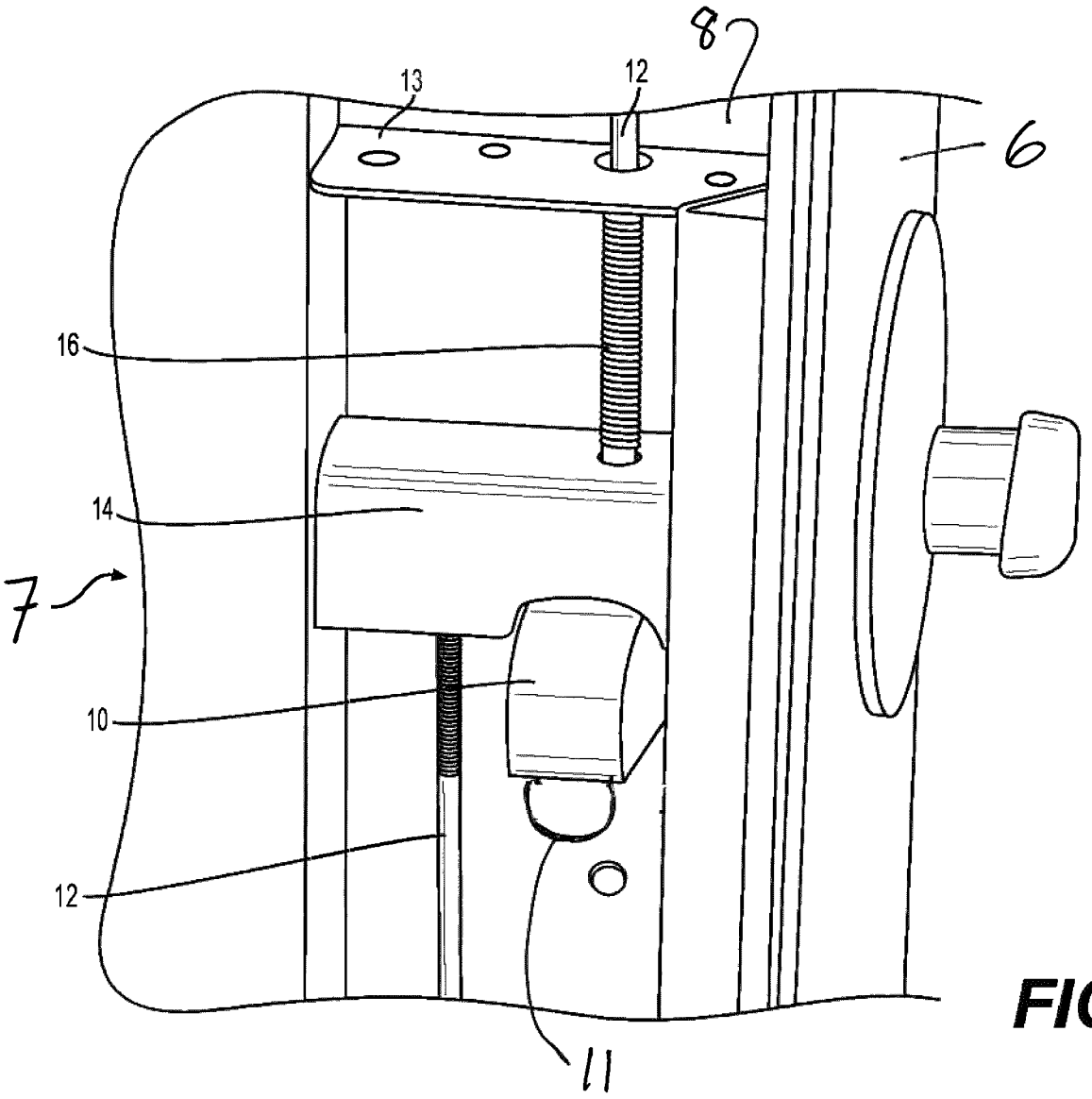
FIG. 11 is a detailed view of the multipoint door lock system of FIG. 7, showing the lever in a resting position, the door now being closed.
Figure 12:
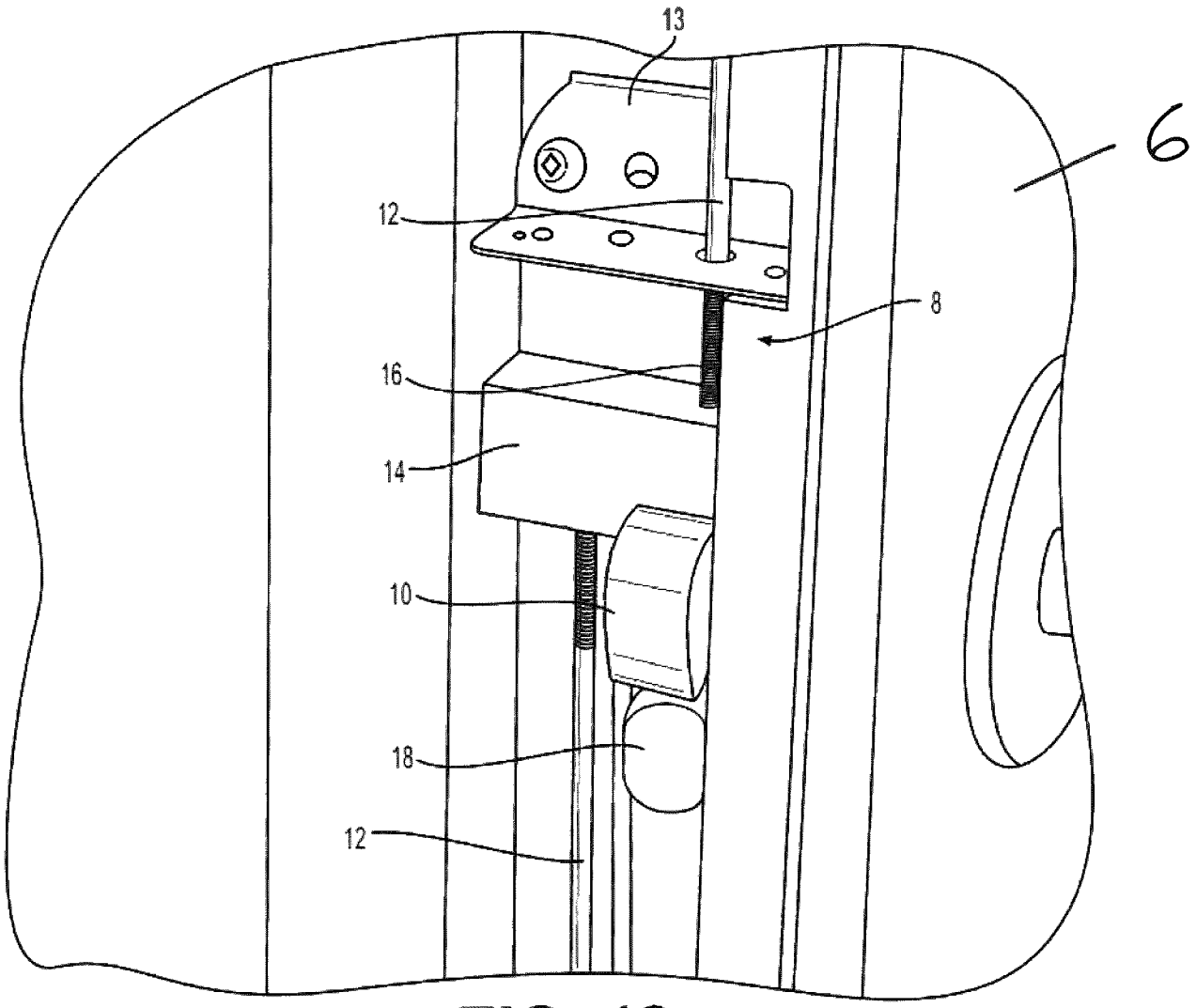
FIG. 12 is a detailed view of the multipoint door lock system of FIG. 7, showing a deadbolt inserted in a bolt opening and the lever in a locking position.

FIG. 10 is a detailed view of the multipoint door lock system of FIG. 7, showing a lever mounted in the subframe and in a resting position, with an open door. FIG. 11 is a detailed view of the multipoint door lock system of FIG. 7, showing the lever in a resting position, the door now being closed. FIG. 12 is a detailed view of the multipoint door lock system of FIG. 7, showing a deadbolt inserted in a bolt opening and the lever in a locking position. A bolt opening 11 is visible on FIG. 10. A lever 10 mounted in a subframe 8 connects to a translating member 12 (proximal ends of two translating members 12 are shown) via an interface block 14. The translating members 12 are held by use of guide plates 13. The lever 10 and the interface block 14 as shown are made of Teflon™, a polymer, or another plastic material. When the deadbolt 18 is not in the bolt opening 11, the lever 10 is in a resting position and the translating members 12 are in retracted positions (FIG. 11). When the deadbolt 18 is in the bolt opening 11, the lever 10 is in a locked position adjacent to the resting position and displaces the interface block 14 that, in turn, brings the translating members 12 in extended positions, compressing biasing elements such as a coil spring 16 mounted on the translating members 12.

Figure 13:
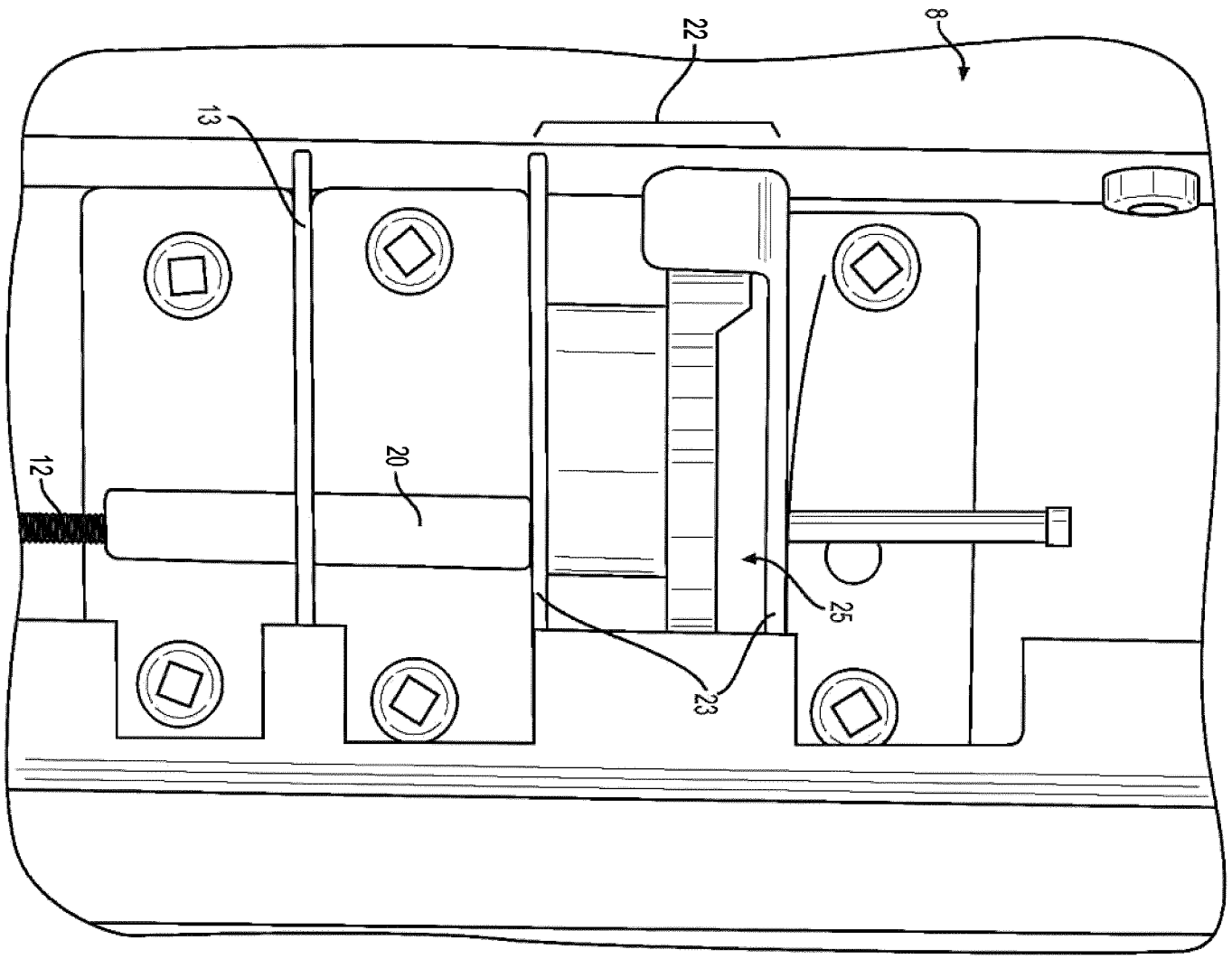
FIG. 13 is a detailed view of the multipoint door lock system of FIG. 7, showing a distal end of a translating member in a retracted position.
Figure 14:
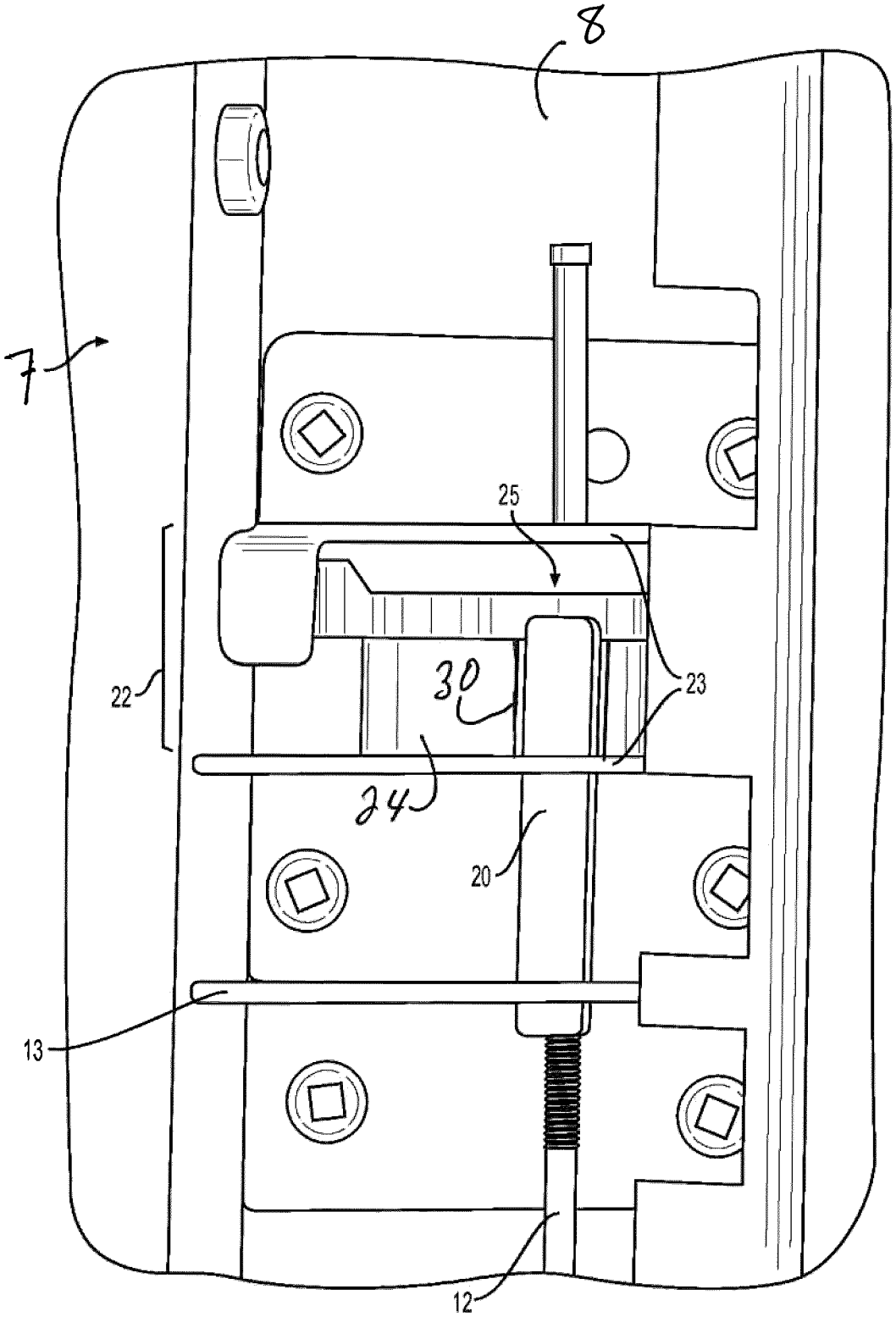
FIG. 14 is a detailed view of the multipoint door lock system of FIG. 7, showing the distal end of the translating member in an extended position.

FIG. 13 is a detailed view of the multipoint door lock system of FIG. 7, showing a distal end of a translating member in a retracted position. FIG. 14 is a detailed view of the multipoint door lock system of FIG. 7, showing the distal end of the translating member in an extended position. FIGS. 13 and 14 show a distal end of one of the translating members, respectively reaching (FIG. 14) and not reaching (FIG. 13) into a secondary opening 22 on the strike jamb 9 of the subframe 8. Pivotable latches are not shown on FIGS. 13 and 14 but are shown in the following Figures. A leaf spring 25 is also shown on FIGS. 13 and 14.

Figure 16:
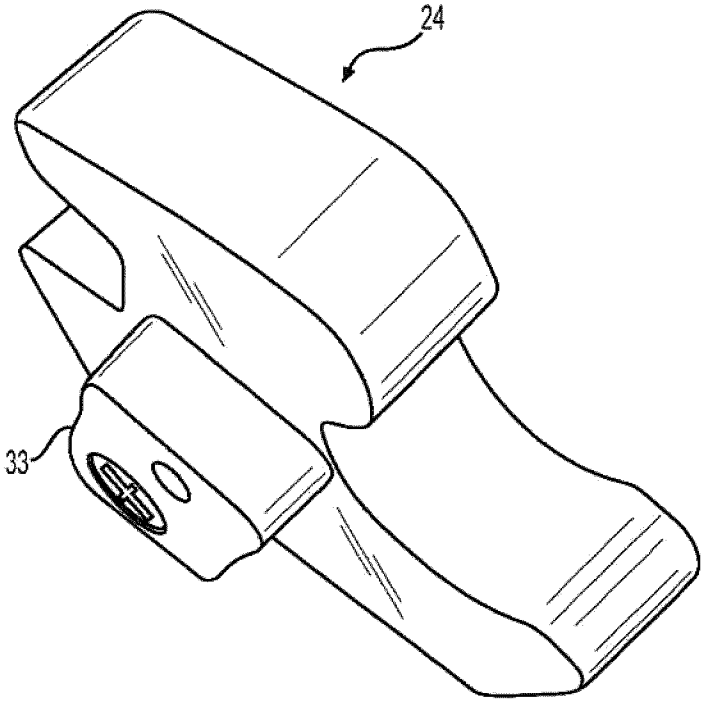
FIG. 16 is a perspective view of the pivotable latch of FIG. 15.
Figure 15:
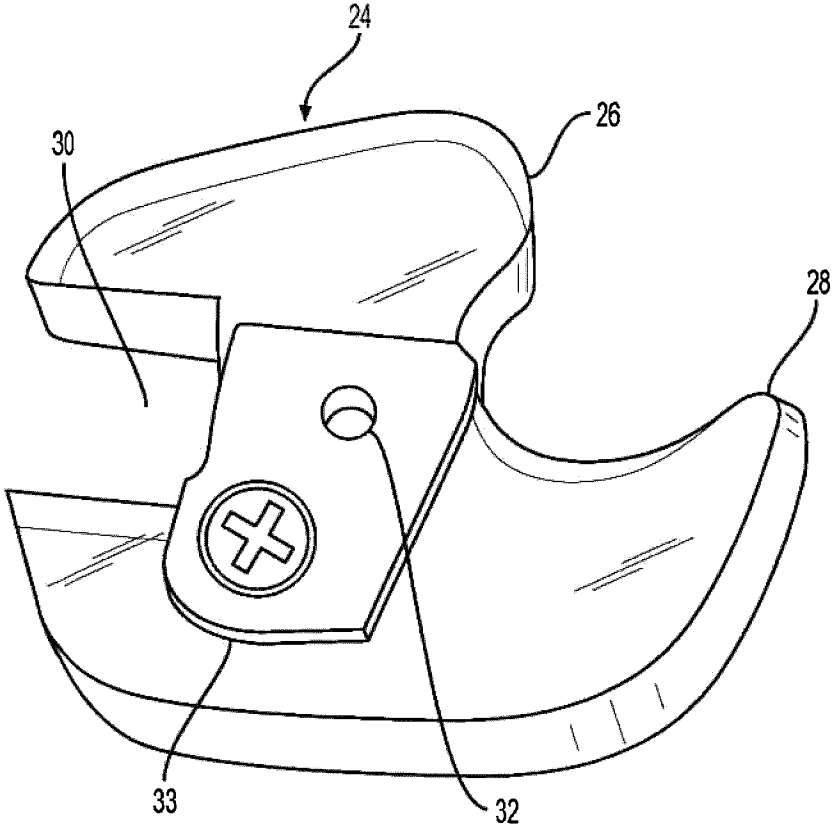
FIG. 15 is a top view of a pivotable latch.

FIG. 15 is a top view of a pivotable latch. FIG. 16 is a perspective view of the pivotable latch of FIG. 15. A pivotable latch 24 has a door-actuated tip 26 that is activable to rotate the pivotable latch 24 by closing action of the door 6, a door-locking tip 28 and a locking recess 30. The pivotable latch 24 also has an opening 32 for mounting the in the subframe 8 in a pivoting fashion. A stopper 33 is also mounted on the pivotable latch 24.

Figure 18:
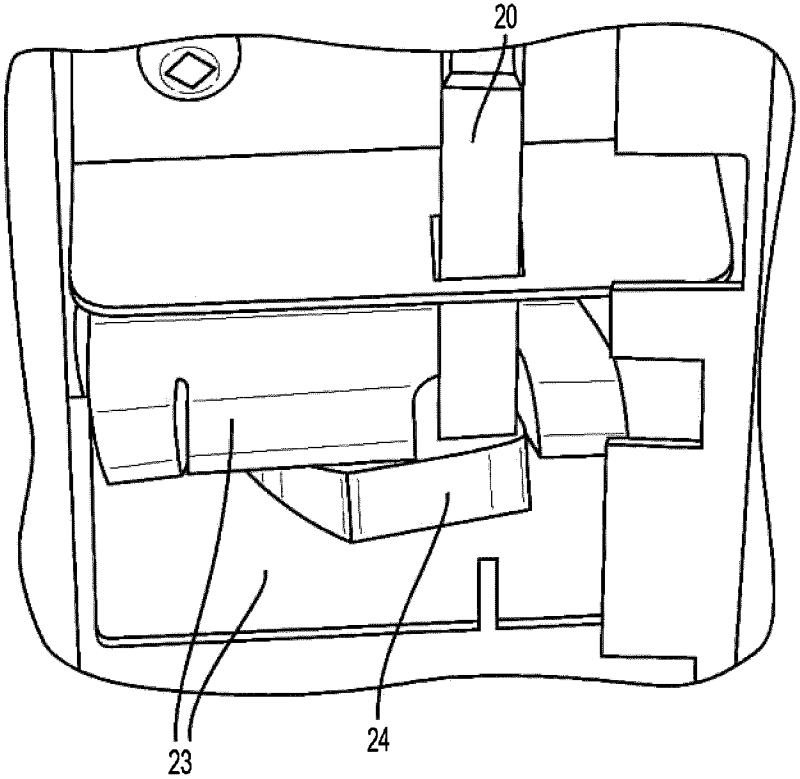
FIG. 18 is a close-up view of the interaction of the distal end of the translating member and of the pivotable latch when the system is unlocked.
Figure 17:
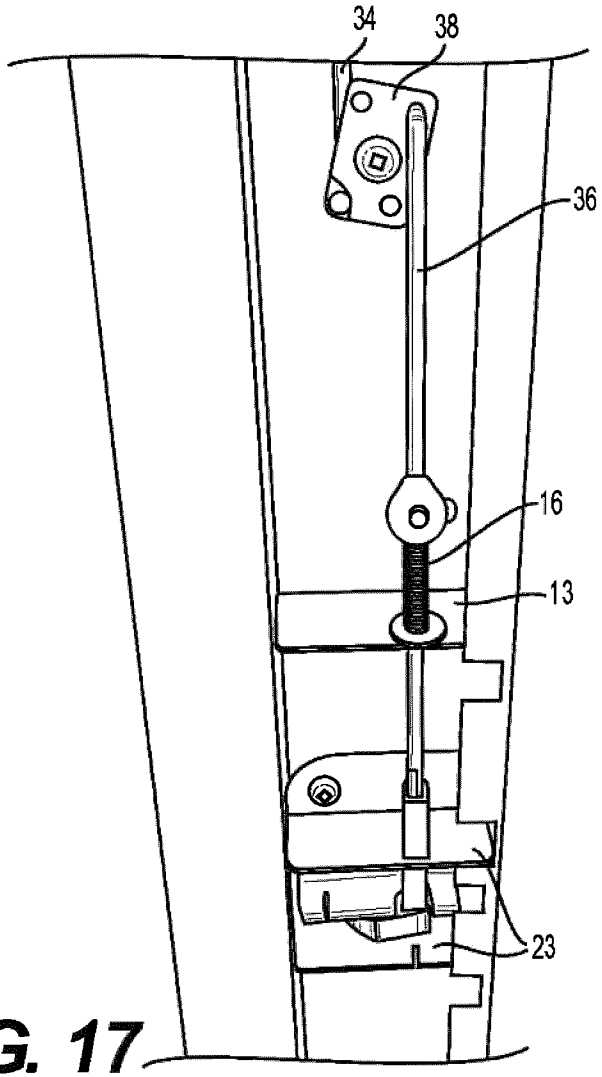
FIG. 17 is a general view showing the interaction of the distal end of the translating member and of the pivotable latch when the system is unlocked.
Figure 20:
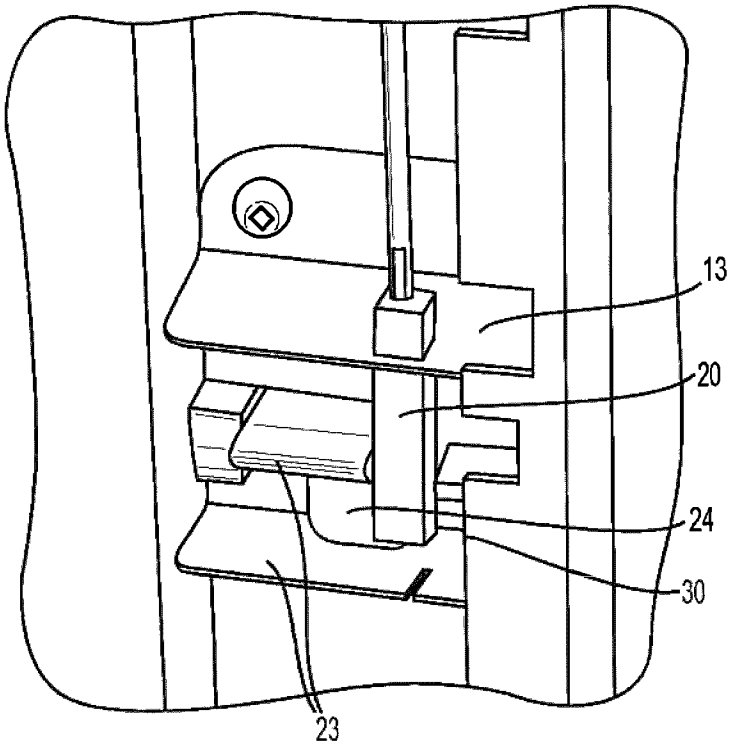
FIG. 20 is a close-up view of the interaction of the distal end of the translating member and of the pivotable latch when the system is locked.
Figure 19:
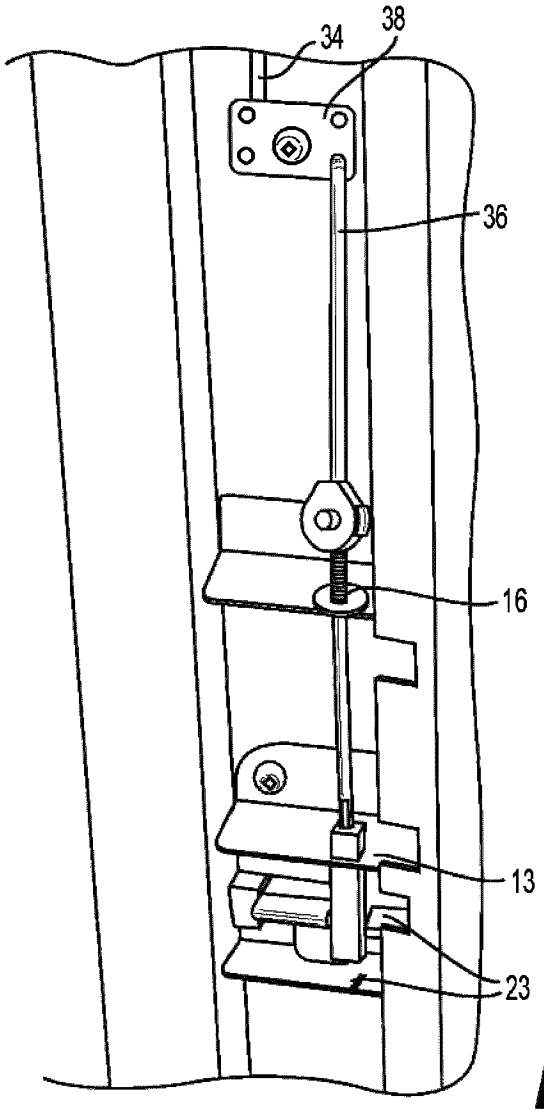
FIG. 19 is a general view showing the interaction of the distal end of the translating member and of the pivotable latch when the system is locked.

FIG. 17 is a general view showing the interaction of the distal end of the translating member and of the pivotable latch when the system is unlocked. FIG. 18 is a close-up view of the interaction of the distal end of the translating member and of the pivotable latch when the system is unlocked. FIG. 19 is a general view showing the interaction of the distal end of the translating member and of the pivotable latch when the system is locked. FIG. 20 is a close-up view of the interaction of the distal end of the translating member and of the pivotable latch when the system is locked. In FIGS. 17-20, the translating member 12 is split into a top section 34, which extends from the interface block 14 of earlier Figures, and a bottom section 36, the top and bottom sections 34 and 36 being linked by a pivoting plate 38. When the interface block 14 is pushed upwards by the lever 10, the top section 34 is pulled upwards, the pivoting plate 38 rotates and the bottom section 36 is pushed downward. As shown on FIGS. 17 and 18, when the bottom section 36 is in its raised position (the translating member 12 formed by the sections 34 and 36 being in the retracted position), a distal end 20 of the translating member 12 does not reach the pivotable latch 24, which is supported by support plates 23. As shown on FIGS. 19 and 20, when the bottom section 38 is in its lowered position (the translating member 12 formed by the sections 34 and 36 being in the extended position), the distal end 20 reaches into the locking recess 30 of the pivotable latch 24, which is thus locked. The locking recess 30 as shown is an indentation adapted to receive the distal end 20, but it could also be an aperture adapted to receive the distal end 20. FIGS. 17 and 19 also show a coil spring 16 mounted on the section 36 of the translating member 12. The coil spring 16 is compressed when the translating member 12 is in the extended position. When the deadbolt 18 is removed from the bolt opening 11, a force exerted by the compressed coil spring 16 causes the translating member 12 to return to its retracted position, causing the interface block 14 to push down on the lever 10 that then returns to the resting position as shown on FIG. 11. In a variant without the presence of the coil springs 16 on the translating members 12, the lever 10 returns to the resting position by gravity, followed by the interface block 14.

Figure 21:
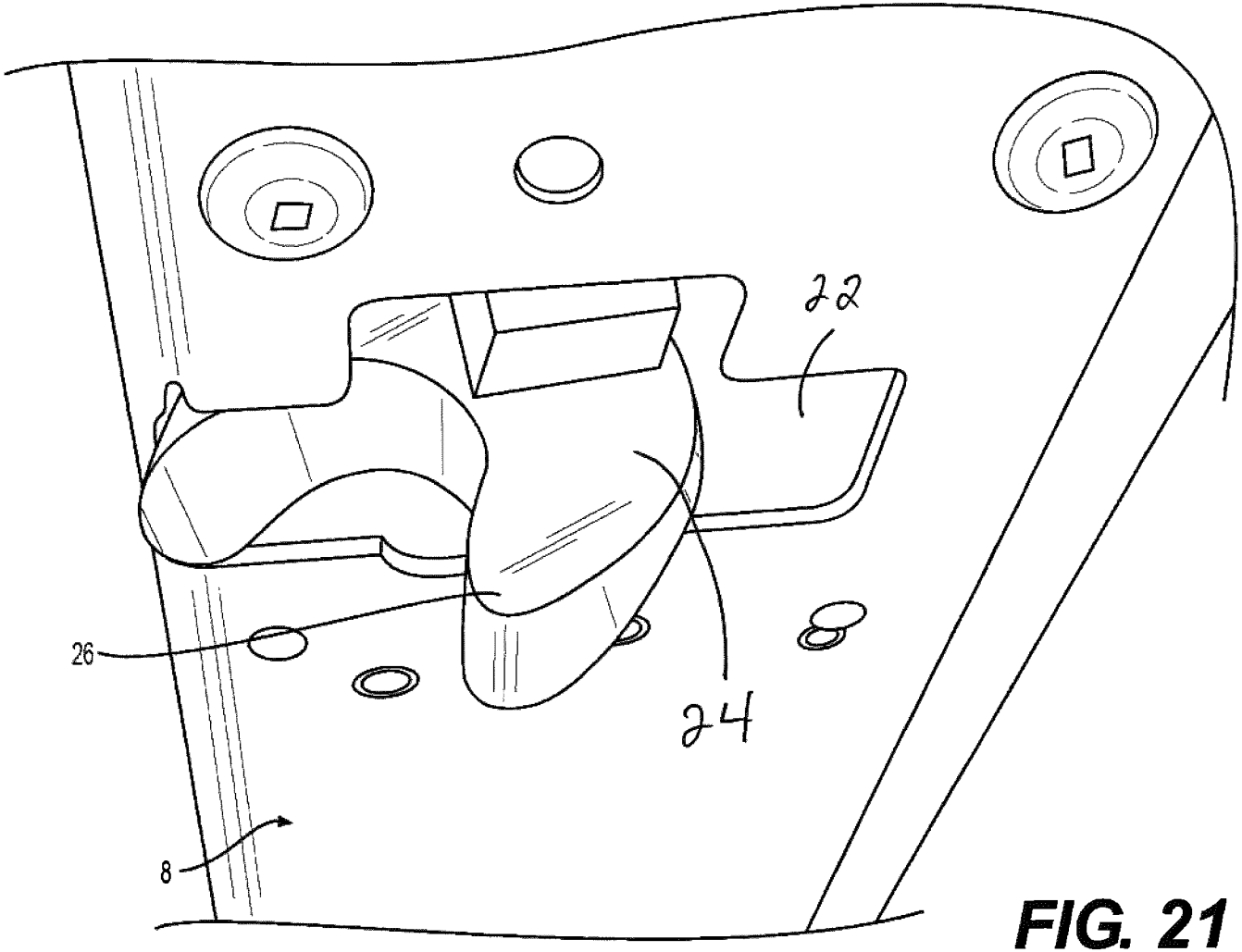
FIG. 21 is a detailed view of a door-actuated tip of the pivotable latch protruding through a secondary opening of the door frame.
Figure 22:
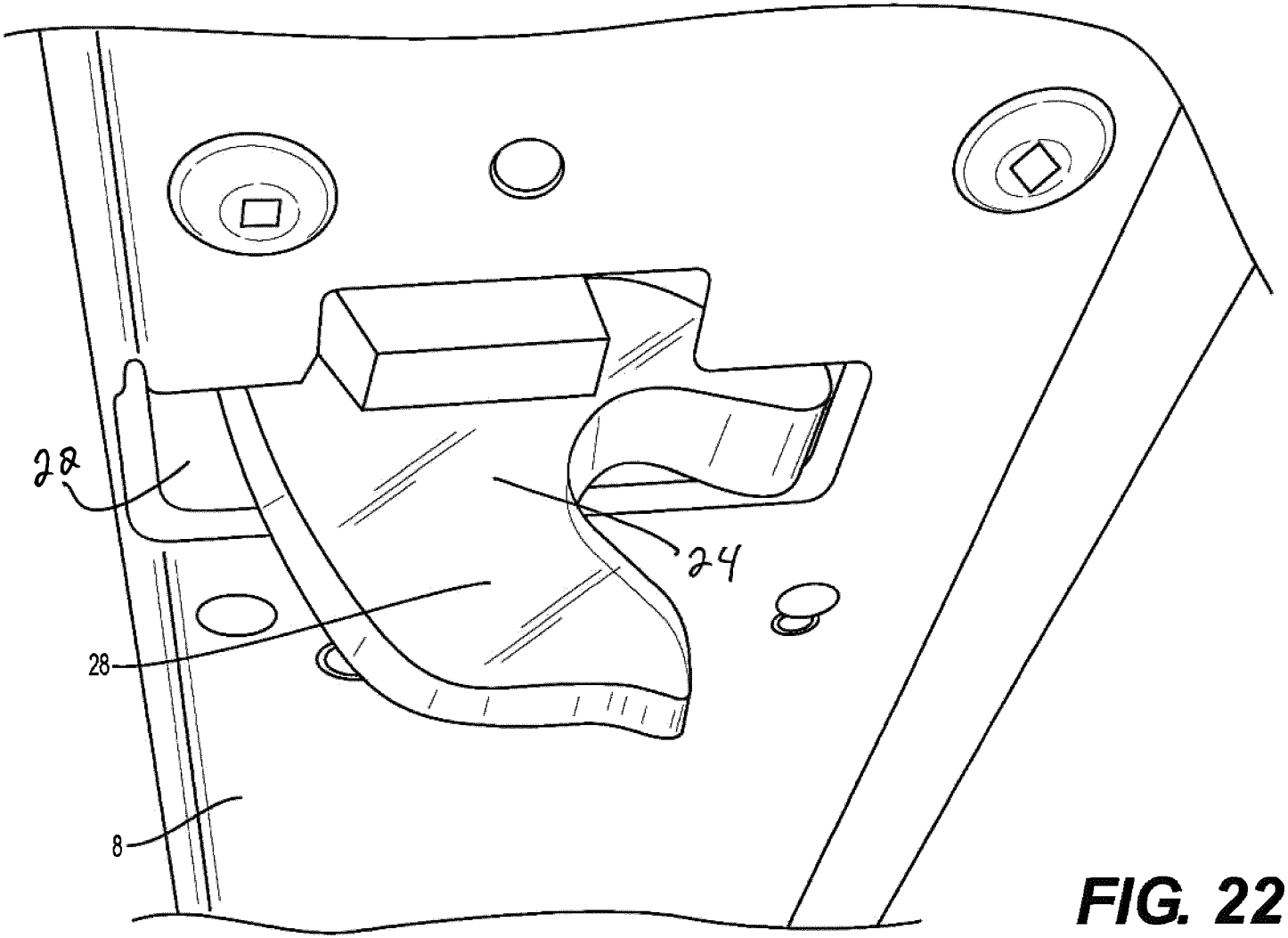
FIG. 22 is a detailed view of a door-locking tip of the pivotable latch protruding through a secondary opening of the door frame.

FIG. 21 is a detailed view of a door-actuated tip of the pivotable latch protruding through a secondary opening of the door frame. FIG. 22 is a detailed view of a door-locking tip of the pivotable latch protruding through a secondary opening of the door frame. These Figures show how the tips of the pivotable latch 24 may be visible from the strike jamb of the subframe 8. It may however be noted that, under normal operation, the door-locking tip of the pivotable latch 24 would not be visible as shown on FIG. 22 since it is intended to protrude from the door frame 7 and into a secondary bore 40 (FIGS. 7 and 23) of the door 6 when the door 6 is closed, thereby being in the pre-armed position of the multipoint door lock system.

In some embodiments, the stopper 33 of the pivotable latch 24 interfaces with the leaf spring 25 shown on FIGS. 13 and 14. As the pivotable latch 24 rotates, the stopper 33 compresses the leaf spring 25. The resulting compression of the leaf spring 25 by the stopper 33 causes the pivotable latch 24 to rapidly move between two (2) stable positions in which either one of the door-actuated tip 26 or the door-locking tip 28 protrudes from subframe 8. This effect of the leaf spring 25 on the pivotable latch 24 facilitates the opening and closing of the door 6 while preventing, in these embodiments, free movement of the pivotable latch 24.

Figure 23:
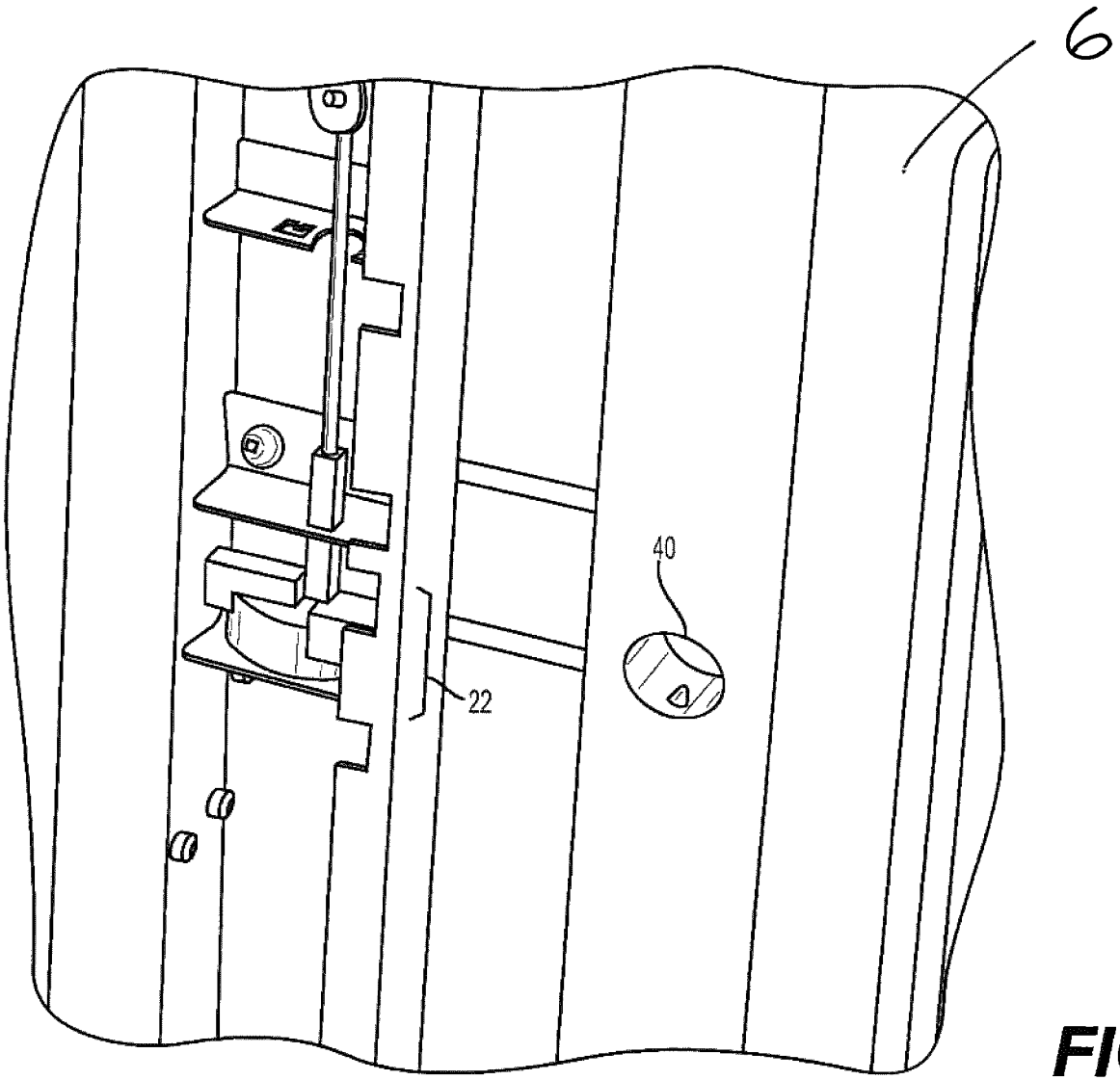
FIG. 23 is a detailed view of a secondary bore on the edge of the door of FIG. 7, vertically aligned with the secondary opening of FIGS. 21 and 22.

FIG. 23 is a detailed view of a secondary bore on the edge of the door of FIG. 7, vertically aligned with the secondary opening of FIGS. 21 and 22. A secondary bore 40 cut into the door will be aligned with the secondary opening 22 when the door is closed so that the door-locking tip 28 can enter the secondary bore 40.

Figure 24:
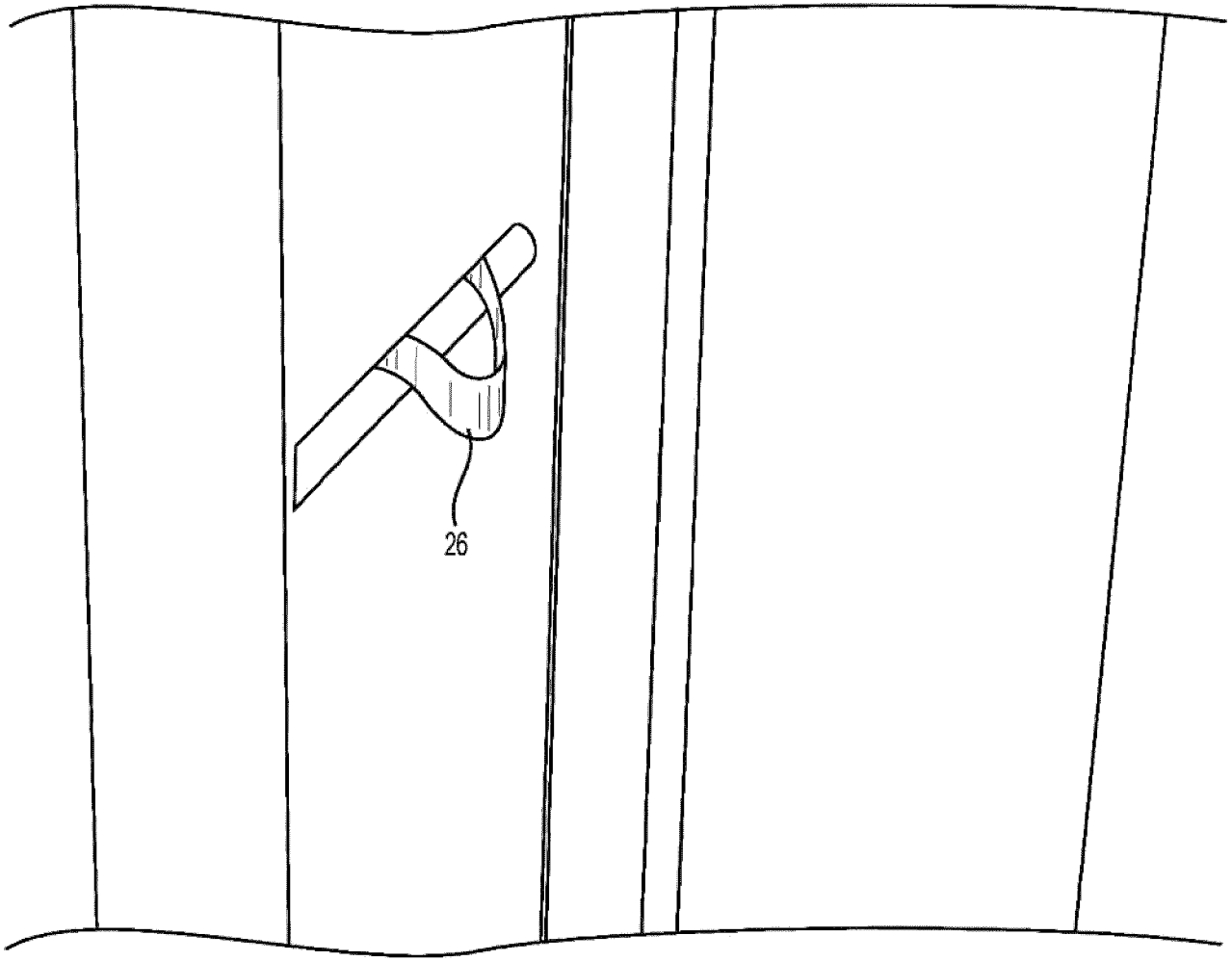
FIG. 24 is a detailed view of the door-actuated tip of the pivotable latch protruding through a protective metal or plastic cover of the subframe.

FIG. 24 is a detailed view of the door-actuated tip of the pivotable latch protruding through a protective metal or plastic cover of the subframe and waiting to be activated, or pushed, by the closing movement of the door within its door frame.

Figure 25:
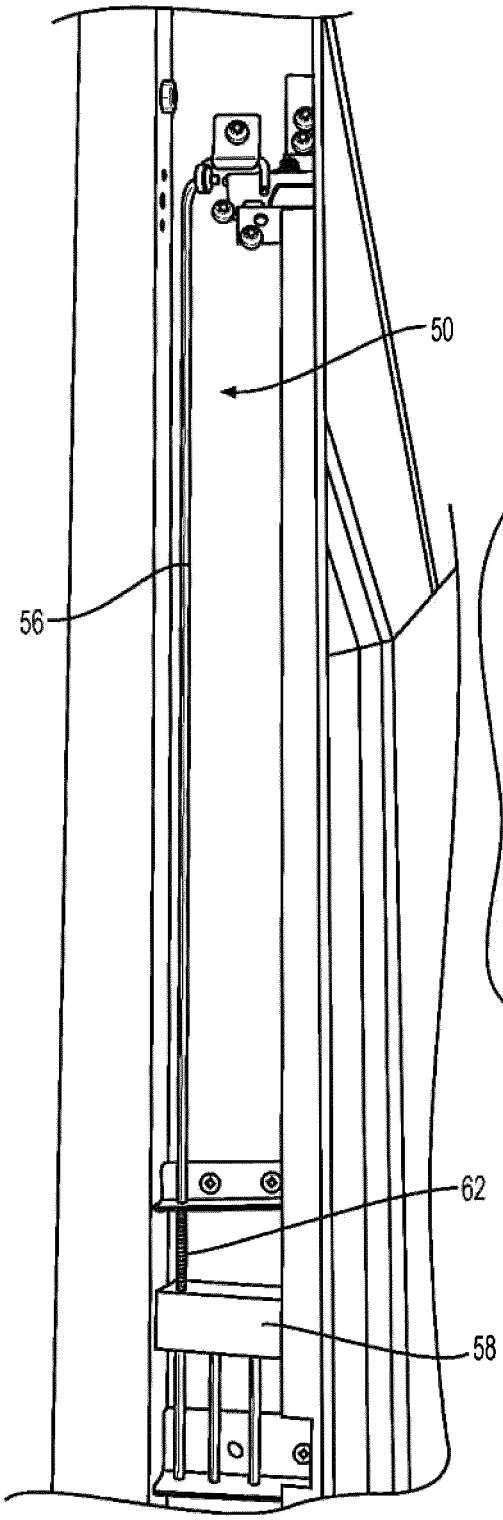
FIG. 25 is a general view of a safety device added to the multipoint door lock system of FIG. 7.
Figure 26:
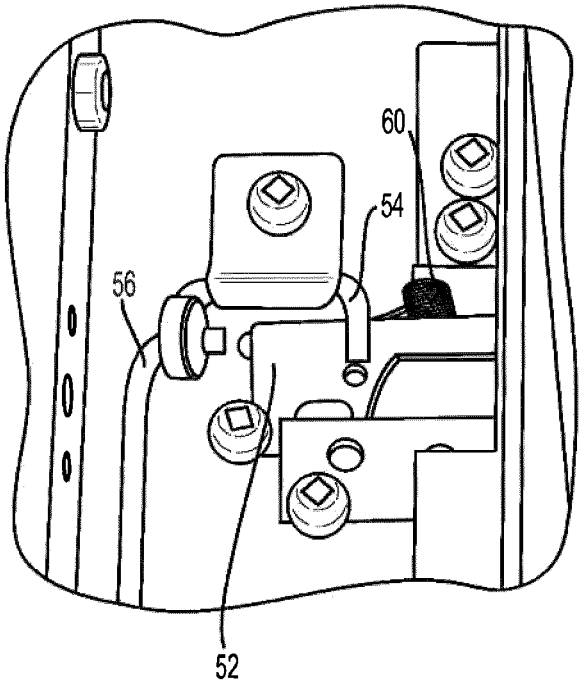
FIG. 26 is a detailed view of the safety device of FIG. 25.
Figure 27:
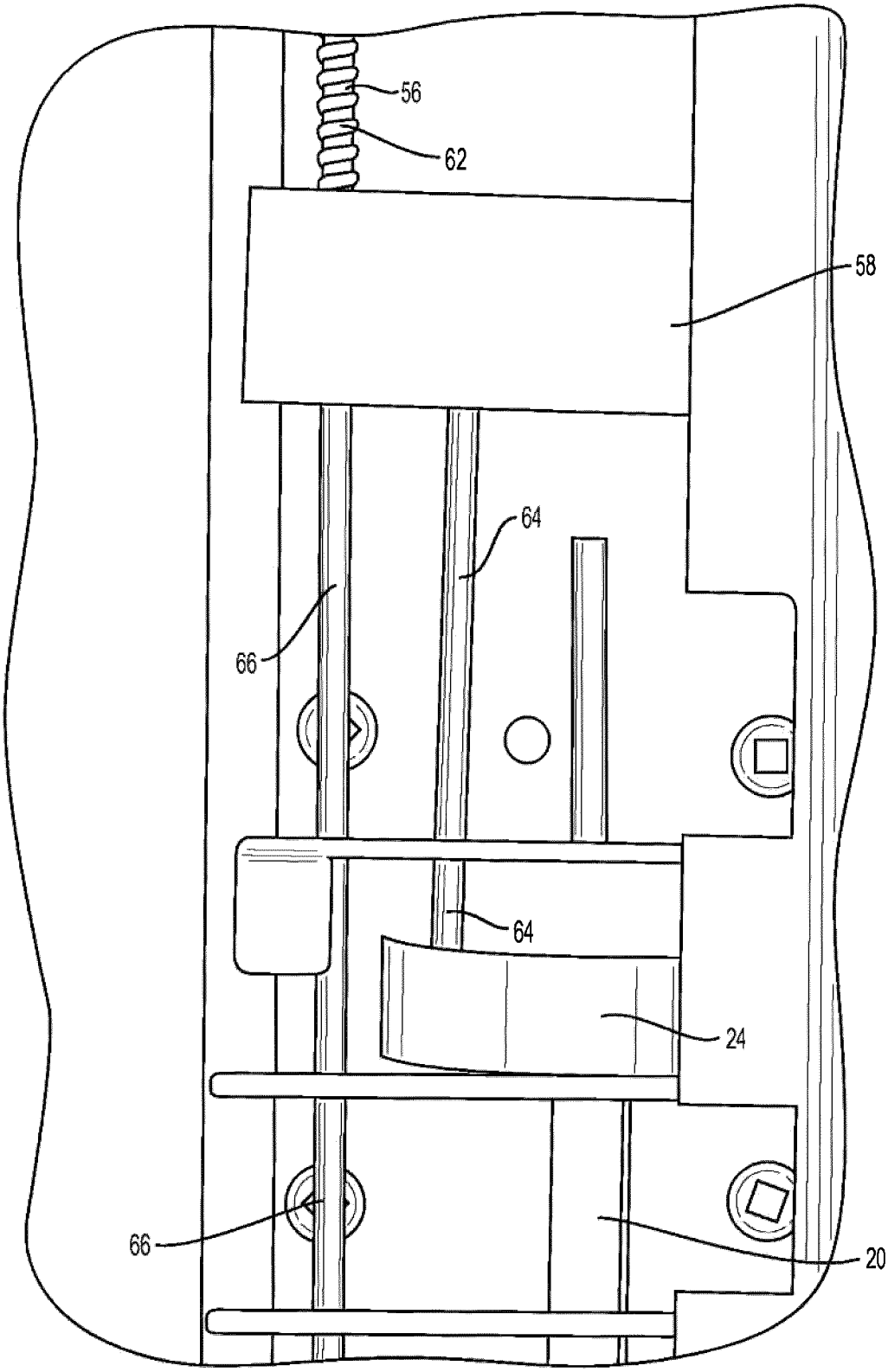
FIG. 27 is another detailed view of the safety device of FIG. 25.

In the multipoint door lock system as shown in the previous drawings, nothing prevents accidentally moving the pivotable latch 24 so that the door-locking tip 28 protrudes from the subframe 8 when the door 6 is open. In a situation where, for instance, a child would play with the pivotable latch 24 and place it in the incorrect position, the edge of the door 6 could hit the door-locking tip 28 upon closing, potentially damaging the door 6 or the multipoint door lock system. The following drawings illustrate a safety device that may optionally be added to the multipoint door locking device. In more details, FIG. 25 is a general view of a safety device added to the multipoint door lock system of FIG. 7, FIG. 26 is a detailed view of the safety device of FIG. 25, and FIG. 27 is another detailed view of the safety device of FIG. 25. As shown on FIGS. 25, 26 and 27, a safety device 50 includes a spring-loaded tab 52 that protrudes through yet another opening (not shown) on the strike jamb of the subframe 8. When the door 6 is closed in the subframe 8 of the door frame 7, the tab 52 pushes on a U-shaped lever 54 connected to a rod 56 so that the rod 56 is raised. Raising the rod 56 in turns lifts a plastic block 58. A coil spring 60 attached to the tab 52 or another coil spring 62 mounted on the rod 56, or both coil springs 60 and 62 acting in combination, provide that the rod 56 is automatically lowered and that the tab 52 automatically protrudes through the subframe 8 when the door 6 is open. Two locking rods 64 and 66 are attached to the block 58 and entrained by the movement of the block 58. Considering FIG. 27 showing the block 58 in the lowered position (the door 6 is open, the tab 52 is not pushed and the rod 56 is lowered), a tip of the locking rod 64 enters in the locking recess 30 of the pivotable latch 24 while, at the same time, the translating member 12 is in the retracted position and its distal end 20 does not lock the pivotable latch 24. Presence of the tip of the locking rod 64 within the locking recess 30 prevents accidentally rotating the pivotable latch 24. The locking rod 66 extends toward the bottom of the multipoint door lock system and likewise engages the other pivotable latch 24.

Upon closing the door 6, the edge of the door 6 at first causes the tab 52 to be pushed into the subframe 8, rotating the U-shaped lever 54, raising the rod 56 and the block 58, and bringing the tips of the locking rods 64 and 66 out of the locking recesses 30 of the pivotable latches 24. Thereafter, the edge of the door 6 pushes on the pivotable latches 24 as explained hereinabove. When the door 6 is opened again, it first causes the pivotable latches 24 to rotate so that their door-actuated tips 26 protrude again. The door 6 then stops pushing on the tab 52, causing the rod 56, the block 58 and the locking rods 64 and 66 to be lowered, blocking the pivotable latches 24 again.

In variants in which one or more additional latches are implemented in the multipoint door lock system, it is contemplated that the safety device 50 may include a corresponding locking rod for each latch. In a specific variant having one pivotable latch 24, the block 58 may be omitted, the rod 56 and the locking rod 64 being optionally combined as a single element for blocking the pivotable latch 24. The safety device 50 can be used in combination with all variants of the multipoint door locking device.

Figure 28:
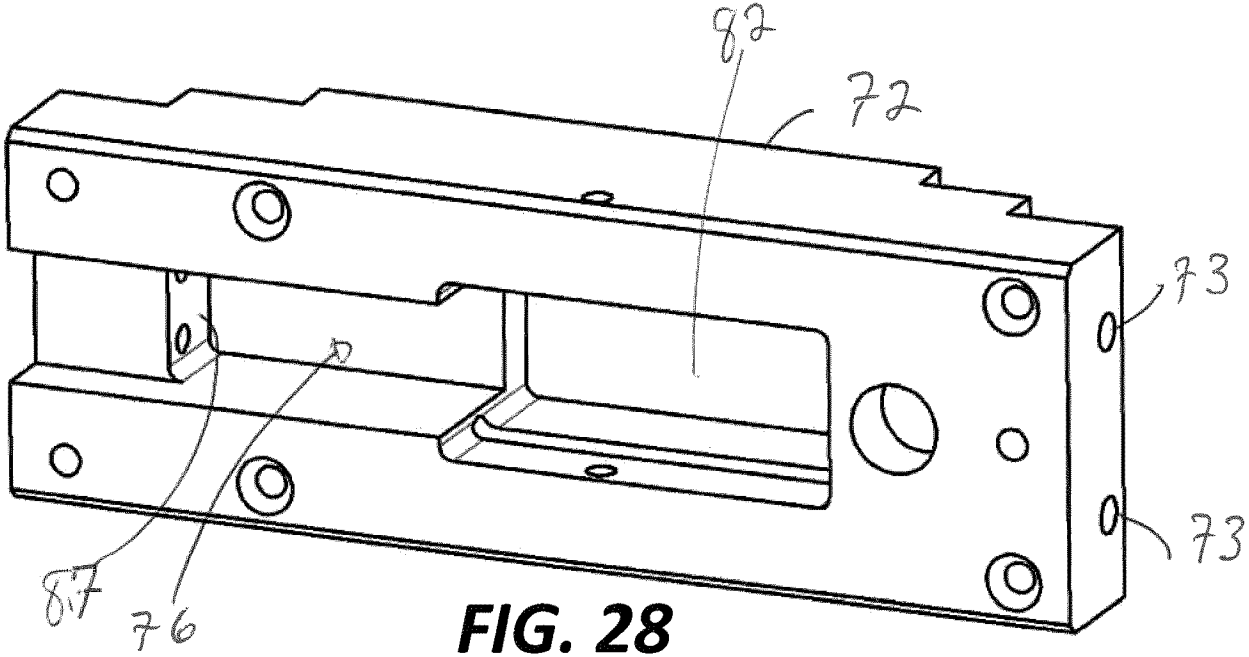
FIG. 28 is a perspective view of a guiding block part of a compressible interface assembly according to an embodiment of the present multipoint door lock system.
Figure 29:
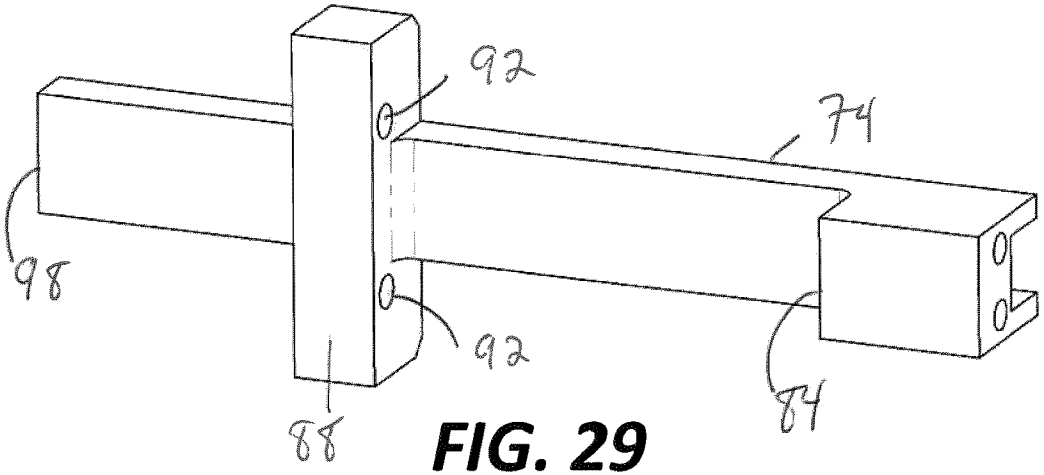
FIG. 29 is a perspective view of a transfer block adapted for cooperating with the guiding block of FIG. 28.
Figure 31:
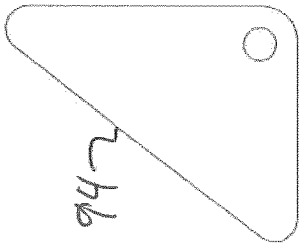
FIG. 31 is a side elevation view of a pusher adapted for emergency unlocking of the multipoint door lock system.
Figure 30:
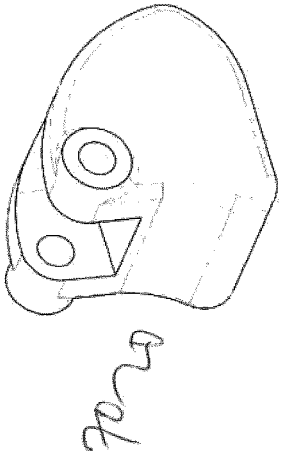
FIG. 30 is a perspective view of a lever adapted for transmitting a motion from a deadbolt to the transfer block of FIG. 29.
Figure 32:
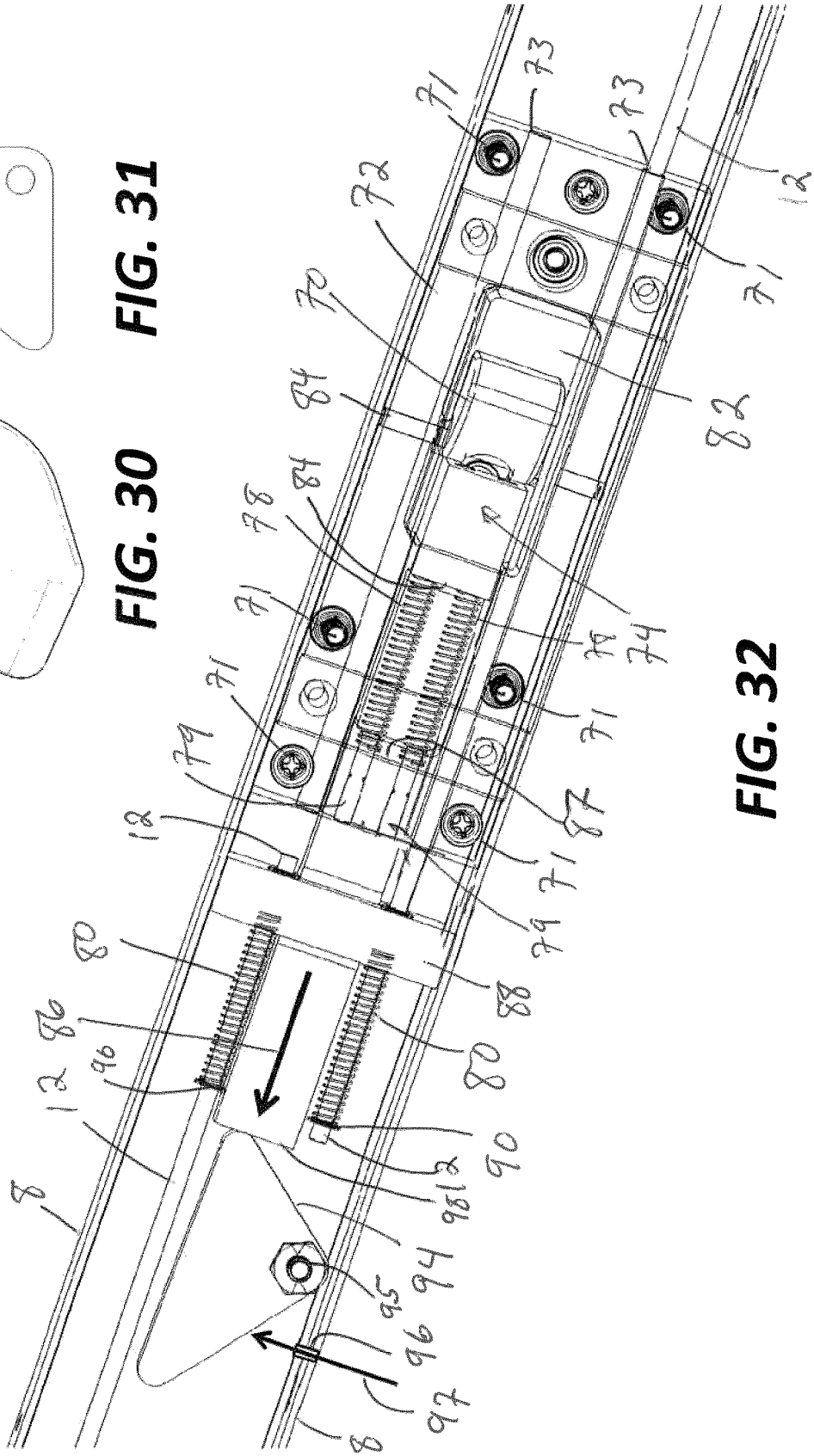
FIG. 32 is a partial side view of a subframe showing the compressible interface assembly including the guiding block, the transfer block and the pusher.

FIG. 28 is a perspective view of a guiding block part of a compressible interface assembly according to an embodiment of the present multipoint door lock system. FIG. 29 is a perspective view of a transfer block adapted for cooperating with the guiding block of FIG. 28. FIG. 30 is a perspective view of a lever adapted for transmitting a motion from a deadbolt to the transfer block of FIG. 29. FIG. 31 is a side elevation view of a pusher adapted for emergency unlocking of the multipoint door lock system. Scale is not maintained between the views of FIGS. 28-31. FIG. 32 is a partial side view of a subframe showing the compressible interface assembly including the guiding block, the transfer block and the pusher. Referring at once to FIGS. 28-32, a compressible interface assembly replaces, in an embodiment, the interface block 14 illustrated in previous Figures. The compressible interface assembly includes a lever 70, a guiding block 72, and a transfer block 74 adapted for sliding in a channel 76 of the guiding block 72, At least one first biasing element, for example first springs 78 mounted on pins 79, are positioned within the channel and connect the transfer block 74 to the guiding block 72. At least one second biasing element, for example second springs 80 mounted on the translating members 12, connect the transfer block 74 to the translating members 12. The translating members 12 are operable to be displaced and lock the latches 24 in their pre-armed positions, as described in relation to the previous Figures.

The guiding block 72 and the lever 70 are mounted in the door frame 7, more particularly to the subframe 8, using screws 71, substantially where the lever 10 and the interface block 14 are positioned in previous Figures. The guiding block 72 has a bolt opening 82 positioned at a level of the bolt opening of the subframe 8. The guiding block 72 has through openings 73 that extend over a entire length of the guiding block 72 to allow free passage therethrough of the translating members 12. In most installations, one of the translating members 12 extends away from the guiding block 72 and only one of the translating members passes through a corresponding through opening 73. The guiding block 72 is manufactured with a pair of through openings 73 to allow selection of either of the translating members 12 passing through the guiding block 72.

Insertion of the deadbolt 18 in the bolt opening 82 forces the lever 70 to pivot about an axis 84 and to move the transfer block 74 from an inactive position, as illustrated on FIG. 32, to an active position. The displacement of the transfer block 74 is in a direction indicated by an arrow 86. As the transfer block 74 moves to the active position, the first springs 78 become compressed between a shoulder 84 of the transfer block 74 and a stop 87 at an end of the channel 76. Hence, the first springs 78 are compressed when the transfer block 74 is in the active position so that, upon removal of the deadbolt from the bolt opening 82, the first springs 78 will cause the transfer block 74 to return to the inactive position.

The transfer block 74 has a transverse bar 88 that presses on the second springs 80 when the transfer block 74 is in the active position. The second springs 80 are terminated by stoppers, for example rings 90, that are fixedly attached to the translating members 12. As such, the pressure from the transfer block 74 is transmitted to the translating members 12 by the second springs 80 and by the rings 90. In normal operation, the displacement of the transfer block 74 from the inactive position to the active position causes a corresponding displacement of the translating members 12, that effectively follow the displacement of the transfer block 74 to lock the respective latches 24 in their pre-armed positions, as in the previous embodiments. If, however, one of the translating members 12 becomes stuck and is prevented from moving, the corresponding second spring 80 becomes compressed between the corresponding ring 90 and the transverse bar 88. The transverse bar 88 has apertures 92 that allow a relative movement between the transfer block 74 and the translating members 12 so that a translating member 12 that is prevented from moving can slide within the aperture 92. Although in that case the translating member 12 may fail to lock the corresponding latch 24 in its pre-armed position, the transfer block 74 is still allowed to move from the inactive to the active position by action of the deadbolt on the lever 70. Hence, the deadbolt is not prevented from entering the bolt opening 82 and the door 6 can still be safely locked, at least by the deadbolt. In embodiments having two distinct translating members 12 and two corresponding latches 24, one of the translating members 12 may successfully lock the corresponding latch 24, even upon blockage the other translating member 12.

In an embodiment, the multipoint door lock system may also comprise a pusher 94. The pusher 94 has a generally triangular shape and is pivotably mounted in the subframe 8, slightly beyond a tip of the transfer block 74 when the transfer block 74 is in the active position. An emergency unlocking aperture 96, accessible by a user from inside the door 6, is provided in the subframe 8. In normal operation, the pusher 94 may rotate freely about an axis 95. For example, when the multipoint door lock system is installed so that the pusher 94 is positioned vertically above the transfer block 74, the pusher 94 may pivot as the transfer block 74 moves between the inactive and active positions. Due for example to an improper installation or insertion of foreign matter in the subframe 8, the translating members 12 and the latches 24 may become stuck in the locked position, even when the deadbolt is removed from the bolt opening 82. The user may unlock the latches 24 by inserting the tip of a thin object, for instance the tip of a nail, in the emergency unlocking aperture 96 to press on the pusher 94, in the direction indicated by arrow 97 on FIG. 32. This pressure will cause the pusher 94 to rotate and press on an end 98 of the transfer block opposite from the bolt opening 82. The transfer block 74 will move toward the inactive position to effectively release the translating members 12 and the latches 24.

Without limitation, the lever 70, the guiding block 72, the transfer block 74 and the pusher 94 as shown may all be made of Teflon™, a polymer, or another plastic material.

Those of ordinary skill in the art will realize that the description of the multipoint door lock system is illustrative only and is not intended to be in any way limiting. Other embodiments will readily suggest themselves to such persons with ordinary skill in the art having the benefit of the present disclosure. Furthermore, the disclosed multipoint door lock system may be customized to offer valuable solutions to existing deficiencies of conventional multipoint door locks.

In the interest of clarity, not all of the routine features of the implementations of the multipoint door lock system are shown and described. It will, of course, be appreciated that in the development of any such actual implementation of the multipoint door lock system, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of door locks having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A multipoint door lock system for a door having on its edge a deadbolt and a secondary bore separated from the deadbolt, comprising:

a door frame having a bolt opening adapted for insertion of the deadbolt and a secondary opening;

a latch mounted in the door frame, the latch taking an activable position when the door is opened and a pre-armed position when the door is closed, a door-locking tip of the latch protruding from the secondary opening of the door frame and into the secondary bore when the door is closed;

a transfer block supported by the door frame, the transfer block moving from an inactive position to an active position upon insertion the deadbolt in the bolt opening;

a first biasing element mounted to the door frame and adapted to cause the transfer block to return to the inactive position when the deadbolt is removed from the bolt opening;

a translating member mounted in the door frame;

a second biasing element connecting the translating member to the transfer block, wherein moving the transfer block to the active position in the absence of a force sufficient to cause a compression of the second biasing element causes a displacement of the translating member to lock the latch in its pre-armed position within the secondary bore.

2. The multipoint door lock system of claim 1, further comprising:

the door.

3. The multipoint door lock system of claim 1, further comprising a guiding block fixedly mounted in the door frame, wherein the transfer block and the first biasing element are mounted to the guiding block.

4. The multipoint door lock system of claim 1, further comprising a lever pivotably supported by the door frame and adapted to pivot upon insertion of the deadbolt in the bolt opening, the lever causing the transfer block to move from the inactive position to the active position upon insertion the deadbolt in the bolt opening.

5. The multipoint door lock system of claim 1, wherein the multipoint door lock system is configured to lock the door by insertion of the deadbolt in the deadbolt opening without locking the latch when the second biasing element is compressed.

6. The multipoint door lock system of claim 1, wherein:

the translating member extends through an aperture of the transfer block; and the second biasing element is a coil spring mounted on the translating member and abutting at one end on the transfer block and at an opposite end on a stopper mounted on the translating member;

wherein compression of the second biasing element causes the translating member to slide through the aperture of the transfer block.

7. The multipoint door lock system of claim 1, further comprising a pusher pivotally mounted in the door frame, the pusher being configured to press on an end of the transfer block opposite from the bolt opening and to cause the transfer block to move toward the inactive position when a pressure is applied on the pusher via an emergency unlocking aperture of the door frame.

8. The multipoint door lock system of claim 1, wherein the guiding block and the transfer block are made of polymer.

9. The multipoint door lock system of claim 1, wherein the latch is pivotable and configured to pivot from the activable position to the pre-armed position upon closing of the door and to pivot from the pre-armed position to the activable position upon opening of the door.

10. The multipoint door lock system of claim 9, wherein the latch comprises a door-actuated tip causing the latch to take the pre-armed position upon closing of the door.

11. The multipoint door lock system of claim 1, wherein the door-locking tip causes the door-actuated tip to protrude from the door frame upon opening of the door.

12. The multipoint door lock system of claim 1, comprising:

two pivotable latches mounted in the door frame on opposite sides of the bolt opening and protruding through two respective secondary openings of the door frame; and two translating members having respective proximal ends operatively connected to the transfer block and respective distal ends extending toward respective ones of the two pivotable latches;

wherein door-locking tips of the two pivotable latches are configured to enter in a two corresponding secondary bores of the door; and wherein, in the absence of the force sufficient to compress the second biasing element, insertion of the deadbolt in the bolt opening causes an insertion of the distal ends of the two translating members in locking recesses of the respective pivotable latches.

13. A multipoint door lock system for a door having on its edge a deadbolt and a secondary bore separated from the deadbolt, comprising:

a door frame having a bolt opening adapted for insertion of the deadbolt and a secondary opening;

a latch mounted in the door frame, the latch taking an activable position when the door is opened and a pre-armed position when the door is closed, a door-locking tip of the latch protruding from the secondary opening of the door frame and into the secondary bore when the door is closed;

a translating member mounted in the door frame;

a lever pivotably supported by the door frame and adapted to pivot upon insertion of the deadbolt in the bolt opening; and a compressible interface assembly operatively connecting the lever to the translating member, the compressible interface assembly being adapted to cause a displacement of the translating member to lock the latch in the pre-armed position within the secondary opening when the lever pivots upon insertion of the deadbolt in the bolt opening in the absence of a force sufficient to compress the compressible interface assembly.

14. A multipoint door lock system, comprising:

a door having on its edge a deadbolt and a secondary bore separated from the deadbolt;

a door frame having a bolt opening adapted for insertion of the deadbolt and a secondary opening;

a latch mounted in the door frame, the latch taking an activable position when the door is opened and a pre-armed position when the door is closed, a door-locking tip of the latch protruding from the secondary opening of the door frame and into the secondary bore when the door is closed;

a translating member mounted in the door frame;

a lever pivotably supported by the door frame and adapted to pivot upon insertion of the deadbolt in the bolt opening; and a compressible interface assembly operatively connecting the lever to the translating member, the compressible interface assembly being adapted to cause a displacement of the translating member to lock the latch in the pre-armed position within the secondary opening when the lever pivots upon insertion of the deadbolt in the bolt opening in the absence of a force sufficient to compress the compressible interface assembly.

15. The multipoint door lock system of claim 13, wherein the compressible interface assembly comprises:

a guiding block fixedly mounted in the door frame;

a transfer block supported by the guiding block and operatively connected to the lever, the transfer block moving from an inactive position to an active position when the lever pivots upon insertion the deadbolt in the bolt opening a first biasing element mounted to the guiding block and adapted to cause the transfer block to return to the inactive position when the deadbolt is removed from the bolt opening;

a second biasing element connecting the transfer block to the translating member, wherein moving the transfer block to the active position in the absence of a force sufficient to cause a compression of the second biasing element causes the displacement of the translating member to lock the latch in its pre-armed position within the secondary bore.

* * * * *